US010576339B2

(12) United States Patent
Schweigert et al.

(10) Patent No.: US 10,576,339 B2
(45) Date of Patent: Mar. 3, 2020

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Bradley D. Schweigert, Anthem, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 16/035,271

(22) Filed: Jul. 13, 2018

(65) Prior Publication Data

US 2018/0318674 A1 Nov. 8, 2018

Related U.S. Application Data

(63) Continuation-in-part of application No. 15/816,517, filed on Nov. 17, 2017, now Pat. No. 10,315,080, (Continued)

(51) Int. Cl.
*A63B 53/04* (2015.01)
*A63B 60/02* (2015.01)
(Continued)

(52) U.S. Cl.
CPC ..... *A63B 53/0487* (2013.01); *A63B 53/02* (2013.01); *A63B 60/02* (2015.10);
(Continued)

(58) Field of Classification Search
CPC ..... A63B 53/0487; A63B 2053/0491; A63B 2053/0433; A63B 60/54; A63B 2053/0408; A63B 2053/0441
See application file for complete search history.

(56) References Cited

U.S. PATENT DOCUMENTS 922,444 A 5/1909 Youds
RE19,178 E 5/1934 Spiker
(Continued)

FOREIGN PATENT DOCUMENTS

JP 2005/160691 A 6/2005

OTHER PUBLICATIONS

U.S. Appl. No. 29/523,587, Schweigert, "Golf Club Head," filed Apr. 10, 2015.

(Continued)

*Primary Examiner* — Michael D Dennis

(57) ABSTRACT

Examples of golf club heads and methods to manufacture golf club heads are generally described herein. In one example, a golf club head may include a body portion with a toe portion, a heel portion, a front portion, a rear portion, a top portion, and a sole portion. The top portion may include a center portion extending from the front portion to the rear portion. A hosel portion may be located in a recess portion of the center portion. The hosel portion may be configured to receive a shaft such that a center axis of the shaft passes through or passes near a center of gravity of the golf club head. Other examples of golf club heads and methods to manufacture the same may be described and claimed.

6 Claims, 19 Drawing Sheets

Related U.S. Application Data which is a continuation of application No. 15/150,006, filed on May 9, 2016, now Pat. No. 10,258,845, which is a continuation-in-part of application No. 14/586,720, filed on Dec. 30, 2014, now Pat. No. 9,440,124, application No. 16/035,271, which is a continuation-in-part of application No. 14/962,953, filed on Dec. 8, 2015, now Pat. No. 10,258,844, which is a continuation of application No. 14/686,466, filed on Apr. 14, 2015, now Pat. No. 9,233,283, application No. 16/035,271, which is a continuation-in-part of application No. 15/188,661, filed on Jun. 21, 2016, now Pat. No. 10,441,858, which is a continuation of application No. 14/812,212, filed on Jul. 29, 2015, now Pat. No. 9,387,375, application No. 16/035,271, which is a continuation-in-part of application No. 15/489,366, filed on Apr. 17, 2017, now Pat. No. 10,124,221, which is a continuation of application No. 15/078,749, filed on Mar. 23, 2016, now Pat. No. 9,649,540, application No. 16/035,271, which is a continuation-in-part of application No. 15/831,151, filed on Dec. 4, 2017, now Pat. No. 10,478,680, application No. 16/035,271, which is a continuation-in-part of application No. 15/922,506, filed on Mar. 15, 2018, now abandoned.

(60) Provisional application No. 62/041,553, filed on Aug. 25, 2014, provisional application No. 61/985,351, filed on Apr. 28, 2014, provisional application No. 61/992,379, filed on May 13, 2014, provisional application No. 62/015,297, filed on Jun. 20, 2014, provisional application No. 62/030,820, filed on Jul. 30, 2014, provisional application No. 62/059,108, filed on Oct. 2, 2014, provisional application No. 62/146,114, filed on Apr. 10, 2015, provisional application No. 62/138,925, filed on Mar. 26, 2015, provisional application No. 62/212,462, filed on Aug. 31, 2015, provisional application No. 62/213,933, filed on Sep. 3, 2015, provisional application No. 62/431,157, filed on Dec. 7, 2016, provisional application No. 62/480,338, filed on Mar. 31, 2017, provisional application No. 62/533,481, filed on Jul. 17, 2017.

(51) Int. Cl.
*A63B 53/02* (2015.01)
*A63B 60/54* (2015.01)

(52) U.S. Cl.
CPC ..... *A63B 60/54* (2015.10); *A63B 2053/0408* (2013.01); *A63B 2053/0433* (2013.01); *A63B 2053/0437* (2013.01); *A63B 2053/0441* (2013.01); *A63B 2053/0491* (2013.01)

(56) References Cited

U.S. PATENT DOCUMENTS

| | | | | |
|---|---|---|---|---|
| 4,043,562 | A | 8/1977 | Shillington | |
| 4,340,230 | A | 7/1982 | Churchward | |
| 4,754,977 | A | 7/1988 | Sahm | |
| 4,869,507 | A | 9/1989 | Sahm | |
| 5,078,398 | A * | 1/1992 | Reed | A63B 53/0487 273/DIG. 14 |
| D335,317 | S | 5/1993 | Shearer | |
| D335,692 | S | 5/1993 | Antonious | |
| D336,757 | S | 6/1993 | Antonious | |
| 5,275,412 | A | 1/1994 | Innes | |
| D350,582 | S | 9/1994 | Miansian et al. | |
| 5,429,366 | A | 7/1995 | McCabe | |
| D363,101 | S | 10/1995 | Sturm | |
| D365,864 | S | 1/1996 | Sturm | |
| 5,489,097 | A | 2/1996 | Simmons | |
| D368,751 | S | 4/1996 | Rife | |
| D369,393 | S | 4/1996 | Takahashi et al. | |
| 5,571,053 | A | 11/1996 | Lane | |
| D378,688 | S | 4/1997 | Cameron | |
| D385,609 | S | 10/1997 | Cameron | |
| 5,683,307 | A | 11/1997 | Rife | |
| D388,143 | S | 12/1997 | Huan-Chiang | |
| D389,207 | S | 1/1998 | Cameron | |
| D398,685 | S | 9/1998 | Masuda | |
| D399,290 | S | 10/1998 | Sizemore, Jr. | |
| D399,911 | S | 10/1998 | Nicolette et al. | |
| 5,830,078 | A * | 11/1998 | McMahan | A63B 53/0487 473/252 |
| 5,839,974 | A | 11/1998 | McAllister | |
| D405,836 | S | 2/1999 | Nicolette et al. | |
| D409,701 | S | 5/1999 | Ashcraft et al. | |
| 5,924,938 | A | 7/1999 | Hines | |
| D422,655 | S | 4/2000 | Hicks | |
| D426,276 | S | 6/2000 | Besnard et al. | |
| D431,854 | S | 10/2000 | Cameron | |
| D432,192 | S | 10/2000 | Hicks | |
| D436,151 | S | 1/2001 | Nicolette et al. | |
| D437,374 | S | 2/2001 | Cameron | |
| D441,820 | S | 5/2001 | Nicolette et al. | |
| D443,668 | S | 6/2001 | Nicolette et al. | |
| D443,905 | S | 6/2001 | Nicolette et al. | |
| D444,833 | S | 7/2001 | Wells et al. | |
| 6,264,571 | B1 | 7/2001 | Lekavich | |
| D449,664 | S | 10/2001 | Beebe et al. | |
| D449,865 | S | 10/2001 | Fife, Jr. et al. | |
| D450,799 | S | 11/2001 | Nicolette et al. | |
| D451,973 | S | 12/2001 | Wells et al. | |
| 6,348,014 | B1 | 2/2002 | Chiu | |
| 6,354,959 | B1 | 3/2002 | Nicolette et al. | |
| 6,394,910 | B1 | 5/2002 | McCarthy | |
| D472,949 | S | 4/2003 | Serrano | |
| D474,821 | S | 5/2003 | Wells et al. | |
| D474,949 | S | 5/2003 | Schaffeld et al. | |
| D483,086 | S | 12/2003 | Schweigert et al. | |
| D486,872 | S | 2/2004 | Schweigert et al. | |
| D488,200 | S | 4/2004 | Olsavsky | |
| D498,276 | S | 11/2004 | Schweigert et al. | |
| D499,778 | S * | 12/2004 | Cameron | D21/742 |
| 6,902,496 | B2 | 6/2005 | Solheim et al. | |
| D512,116 | S | 11/2005 | Miraflor et al. | |
| 6,988,956 | B2 | 1/2006 | Cover et al. | |
| D520,088 | S | 5/2006 | Parr | |
| D531,242 | S | 10/2006 | Adams | |
| D532,067 | S | 11/2006 | Soracco et al. | |
| 7,153,220 | B2 | 12/2006 | Lo | |
| D534,595 | S | 1/2007 | Hasebe | |
| 7,156,752 | B1 | 1/2007 | Bennett | |
| D536,401 | S | 2/2007 | Kawami | |
| D536,403 | S | 2/2007 | Kawami | |
| D538,371 | S | 3/2007 | Kawami | |
| 7,204,761 | B2 | 4/2007 | Cover et al. | |
| D542,869 | S | 5/2007 | Adams | |
| D543,598 | S | 5/2007 | Kuan et al. | |
| D543,601 | S | 5/2007 | Kawami | |
| D555,219 | S | 11/2007 | Lin | |
| D556,277 | S | 11/2007 | Broom | |
| 7,309,297 | B1 | 12/2007 | Solari | |
| D561,854 | S | 2/2008 | Morris | |
| 7,331,876 | B2 | 2/2008 | Klein | |
| 7,351,162 | B2 | 4/2008 | Soracco et al. | |
| D569,461 | S | 5/2008 | Morris | |
| D569,930 | S | 5/2008 | Nehrbas | |
| 7,396,289 | B2 | 7/2008 | Soracco et al. | |
| D577,085 | S | 9/2008 | Nicolette et al. | |
| D577,086 | S | 9/2008 | Nicolette et al. | |
| D579,506 | S | 10/2008 | Nicolette et al. | |
| D579,995 | S | 11/2008 | Nicolette et al. | |
| D582,497 | S | 12/2008 | Rollinson | |
| 7,473,189 | B2 | 1/2009 | Schweigert et al. | |
| 7,491,131 | B2 | 2/2009 | Vinton | |

(56) References Cited

U.S. PATENT DOCUMENTS

| | | | |
|---|---|---|---|
| D595,793 | S | 7/2009 | Rollinson |
| D599,425 | S | 9/2009 | Laub |
| D600,763 | S | 9/2009 | Cameron |
| 7,744,485 | B2 | 6/2010 | Jones et al. |
| D620,993 | S | 8/2010 | Laub |
| D621,461 | S | 8/2010 | Serrano |
| D623,709 | S | 9/2010 | Serrano et al. |
| D631,925 | S | 2/2011 | Broom |
| 7,887,432 | B2 | 2/2011 | Jones et al. |
| 7,909,707 | B2 | 3/2011 | Klein |
| 7,918,745 | B2 | 4/2011 | Morris et al. |
| D638,891 | S | 5/2011 | Nicolette et al. |
| D642,643 | S | 8/2011 | Nicolette et al. |
| D643,485 | S | 8/2011 | Nicolette et al. |
| D645,104 | S | 9/2011 | Nicolette et al. |
| 8,096,039 | B2 | 1/2012 | Soracco et al. |
| D653,718 | S | 2/2012 | Stokke et al. |
| D661,753 | S | 6/2012 | Cameron et al. |
| D666,260 | S | 8/2012 | Cynn |
| 8,376,878 | B2 | 2/2013 | Bennett et al. |
| D688,339 | S | 8/2013 | Hilton et al. |
| D688,341 | S | 8/2013 | Rollinson |
| D691,226 | S | 10/2013 | Hilton et al. |
| D699,308 | S | 2/2014 | Rollinson |
| 8,696,492 | B1 | 4/2014 | Hocknell et al. |
| D704,782 | S | 5/2014 | Rollinson |
| 8,721,472 | B2 | 5/2014 | Kuan et al. |
| 8,790,193 | B2 | 7/2014 | Serrano et al. |
| D711,483 | S | 8/2014 | Wong |
| D715,388 | S | 10/2014 | Serrano |
| D722,350 | S | 2/2015 | Schweigert |
| D722,351 | S | 2/2015 | Parsons |
| D722,352 | S | 2/2015 | Nicolette et al. |
| D723,120 | S | 2/2015 | Nicolette |
| D724,164 | S | 3/2015 | Schweigert et al. |
| D725,208 | S | 3/2015 | Schweigert |
| D726,265 | S | 4/2015 | Nicolette |
| D726,846 | S | 4/2015 | Schweigert |
| D730,462 | S | 5/2015 | Becktor |
| D732,122 | S | 6/2015 | Becktor |
| D732,618 | S | 6/2015 | Becktor |
| D733,234 | S | 6/2015 | Nicolette |
| D738,447 | S | 9/2015 | Schweigert |
| D738,449 | S | 9/2015 | Schweigert |
| D739,487 | S | 9/2015 | Schweigert |
| D741,426 | S | 10/2015 | Schweigert |
| D748,213 | S | 1/2016 | Parsons et al. |
| D748,215 | S | 1/2016 | Parsons et al. |
| D753,252 | S | 4/2016 | Schweigert |
| 2004/0138003 | A1 | 7/2004 | Grace |
| 2004/0180730 | A1 | 9/2004 | Franklin et al. |
| 2006/0052178 | A1 | 3/2006 | Franklin et al. |
| 2006/0094522 | A1 | 5/2006 | Tang et al. |
| 2006/0223649 | A1 | 10/2006 | Rife |
| 2007/0042831 | A1* | 2/2007 | Haines ..... A63B 53/02 473/313 |
| 2007/0129163 | A1 | 6/2007 | Solari |
| 2007/0142122 | A1 | 6/2007 | Bonneau |
| 2007/0207875 | A1 | 9/2007 | Kuan et al. |
| 2007/0238548 | A1 | 10/2007 | Johnson |
| 2008/0139333 | A1 | 6/2008 | Klein |
| 2008/0146372 | A1 | 6/2008 | John |
| 2008/0176672 | A1 | 7/2008 | Roach et al. |
| 2009/0029800 | A1 | 1/2009 | Jones et al. |
| 2011/0165959 | A1 | 7/2011 | Klein |
| 2013/0165256 | A1 | 6/2013 | Stevenson |
| 2013/0210537 | A1 | 8/2013 | Ainscough et al. |
| 2017/0036078 | A1 | 2/2017 | Serrano et al. |

OTHER PUBLICATIONS

TourSpecGolf (Gold's Factory Multi Weighted Custom Putter) [online]. Nov. 20, 2010 [retrieved Apr. 21, 2016]. Retrieved from the internet: <URL: http://www.tourspecgolf.com/blog/golds-factory-multi-weighted-custom-putter/>.

* cited by examiner

GOLF CLUB HEADS AND METHODS TO MANUFACTURE GOLF CLUB HEADS

CROSS REFERENCE

This application is a continuation-in-part of application Ser. No. 15/816,517, filed Nov. 17, 2017, which is a continuation of application Ser. No. 15/150,006, filed May 9, 2016, which is a continuation-in-part of application Ser. No. 14/586,720, filed Dec. 30, 2014, now U.S. Pat. No. 9,440,124, which claims the benefit of U.S. Provisional Application No. 62/041,553, filed Aug. 25, 2014.

This application is a continuation-in-part of application Ser. No. 14/962,953, filed Dec. 8, 2015, which is a continuation of application Ser. No. 14/686,466, filed Apr. 14, 2015, now U.S. Pat. No. 9,233,283, which claims the benefit of U.S. Provisional Application No. 61/985,351, filed Apr. 28, 2014, U.S. Provisional Application No. 61/992,379, filed May 13, 2014, U.S. Provisional Application No. 62/015,297, filed Jun. 20, 2014, U.S. Provisional Application No. 62/030,820, filed Jul. 30, 2014, and U.S. Provisional Application No. 62/059,108, filed Oct. 2, 2014.

This application is a continuation-in-part of application Ser. No. 15/188,661, filed Jun. 21, 2016, which is a continuation of application Ser. No. 14/812,212, filed Jul. 29, 2015, which claims the benefit of U.S. Provisional Application No. 62/030,820, filed Jul. 30, 2014, and U.S. Provisional Application No. 62/146,114, filed Apr. 10, 2015.

This application is a continuation-in-part of application Ser. No. 15/489,366, filed Apr. 17, 2017, which is a continuation of application Ser. No. 15/078,749, filed Mar. 23, 2016, which claims the benefit of U.S. Provisional Application No. 62/138,925, filed Mar. 26, 2015, U.S. Provisional Application No. 62/212,462, filed Aug. 31, 2015, and U.S. Provisional Application No. 62/213,933, filed Sep. 3, 2015.

This application is a continuation-in-part of application Ser. No. 15/831,151, filed Dec. 4, 2017, which claims the benefit of U.S. Provisional Application No. 62/431,157, filed Dec. 7, 2016.

This application is a continuation-in-part of application Ser. No. 15/922,506, filed Mar. 15, 2018, which claims the benefit of U.S. Provisional Application No. 62/480,338, filed Mar. 31, 2017.

This application claims the benefit of U.S. Provisional Application No. 62/533,481, filed Jul. 17, 2017.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Proper alignment of a golf club head at an address position relative to a golf ball may improve the performance of an individual. Various alignment aids have been used on the golf club heads to improve the individual's visual alignment.

Figure 1:
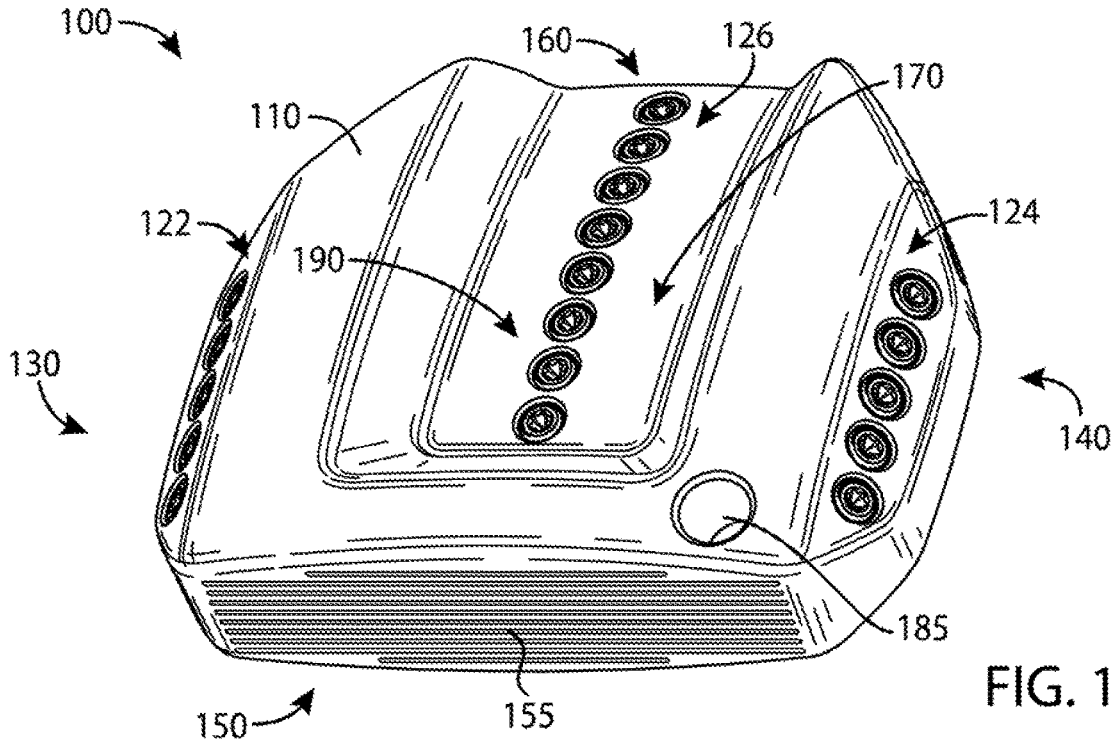
FIG. 1 depicts a front and top perspective view of a golf club head according to an example of the apparatus, methods, and articles of manufacture described herein.
Figure 2:
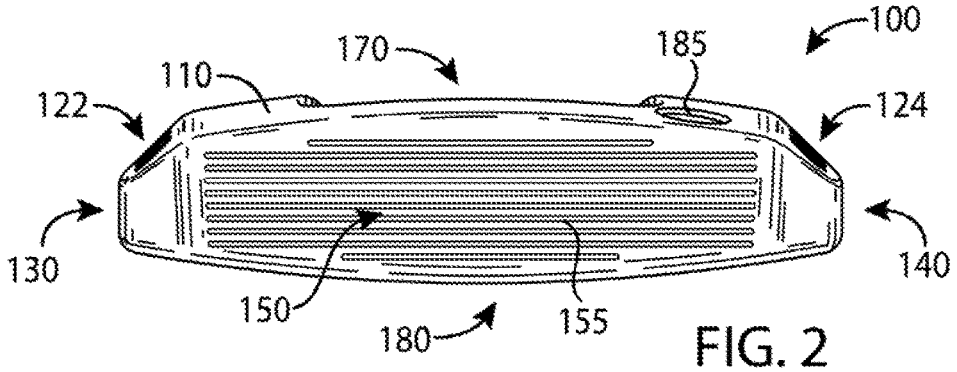
FIG. 2 depicts a front view of the example golf club head of FIG. 1.
Figure 3:
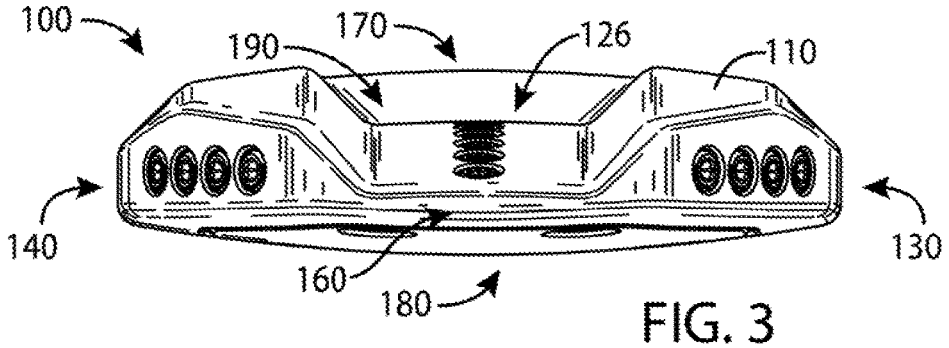
FIG. 3 depicts a rear view of the example golf club head of FIG. 1.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club heads and methods to manufacture golf club heads are described herein. The apparatus, methods, and articles of manufacture described herein are not limited in this regard.

In the example of FIGS. 1-13, a golf club head 100 may include a body portion 110 and a visual guide portion, which is generally shown as a first visual guide portion 122, a second visual guide portion 124, and a third visual guide portion 126. The body portion 110 may include a toe portion 130, a heel portion 140, a front portion 150, a rear portion 160, a top portion 170, and a sole portion 180. The body portion 110 may also include a bore 185 to receive a shaft (not shown) with a grip (not shown). Alternatively, the body portion 110 may include a hosel (not shown) to receive the shaft. The golf club head 100 and the grip may be located on opposite ends of the shaft to form a golf club. The apparatus, methods, and articles of manufacture described herein are not limited in this regard.

The body portion 110 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 110 may be partially or entirely made of a non-metal material (e.g., composite, plastic, etc.). The golf club head 100 may be a putter-type golf club head (e.g., a blade-type putter, a mid-mallet-type putter, a mallet-type putter, etc.). Based on the type of putter as mentioned above, the body portion 110 may be at least 200 grams. For example, the body portion 110 may be in a range between 300 to 600 grams. The apparatus, methods, and articles of manufacture described herein are not limited in this regard.

The toe and heel portions 130 and 140, respectively, may be on opposite ends of the body portion 110 and may define a width of the body portion 110. The front and rear portions 150 and 160, respectively, may be on opposite ends of the body portion 110 and may define a length of the body portion 110. The front portion 150 may include a face portion 155 (e.g., a strike face), which may be used to impact a golf ball (not shown). The face portion 155 may be an integral portion of the body portion 110. Alternatively, the face portion 155 may be a separate piece or an insert coupled to the body portion 110 via various manufacturing and/or processes (e.g., a bonding process, a welding process, a brazing process, a mechanical locking method, a mechanical fastening method, any combination thereof, or other suitable types of manufacturing methods and/or processes). The face portion 155 may be associated with a loft plane that defines the loft angle of the golf club head 100. The apparatus, methods, and articles of manufacture described herein are not limited in this regard.

Figure 8:
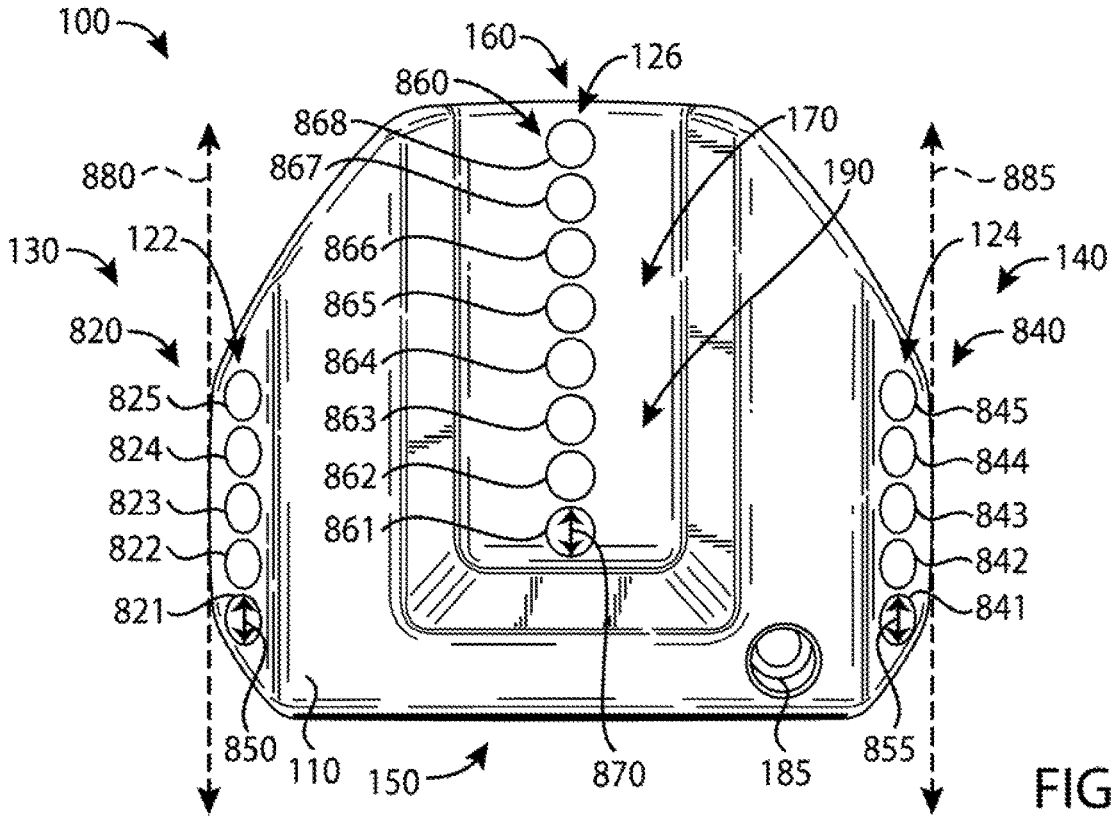
FIG. 8 depicts a top view of a body portion of the example golf club head of FIG. 1.

As illustrated in FIG. 8, for example, the body portion 110 may include two or more weight ports, generally shown as a first set of weight ports 820 (e.g., shown as weight ports 821, 822, 823, 824, and 825) to form the first visual guide portion 122 and a second set of weight ports 840 (e.g., shown as weight ports 841, 842, 843, 844, and 845) to form the second visual guide portion 124. The first and second sets of weight ports 820 and 840, respectively, may be exterior weight ports configured to receive one or more weight portions (e.g., one shown as 1000 in FIG. 10). In particular, the first and second sets of weight ports 820 and 840 may be located at or proximate to a periphery of the golf club head 100. For example, the first and second sets of weight ports 820 and 840, respectively, may be on or proximate to the top portion 170. The first set of weight ports 820 may be at or proximate to the toe portion 130 whereas the second set of weight ports 840 may be at or proximate to the heel portion 140. The apparatus, methods, and articles of manufacture described herein are not limited in this regard.

Each weight port of the first set of weight ports 820 may have a first port diameter ($PD_1$) 850. In particular, a uniform distance of less than the first port diameter 850 may separate any two adjacent weight ports of the first set of weight ports 820 (e.g., (i) weight ports 821 and 822, (ii) weight ports 822 and 823, (iii) weight ports 823 and 824, or (iv) weight ports 824 and 825). In one example, the first port diameter 850 may be about 0.25 inch (6.35 millimeters) and any two adjacent weight ports of the first set of weight ports 820 may be separated by 0.1 inch (2.54 millimeters). In a similar manner, each weight port of the second set of weight ports 840 may have a second port diameter ($PD_2$) 855. A uniform distance of less than the second port diameter 855 may separate any two adjacent weight ports of the second set of weight ports 840 (e.g., (i) weight ports 841 and 842, (ii) weight ports 842 and 843, (iii) weight ports 843 and 844, or (iv) weight ports 844 and 845). For example, the second port diameter 855 may be about 0.25 inch (6.35 millimeters) and any two adjacent weight ports of the second set of weight ports 840 may be separated by 0.1 inch (2.54 millimeters). The first and second port diameters 850 and 855 may be equal (i.e., $PD_1=PD_2$). Alternatively, the first and second port diameters 850 and 855 may be different. The apparatus, methods, and articles of manufacture described herein are not limited in this regard.

As noted above, the visual guide portion may include the third visual guide portion 126. Accordingly, the body portion 110 may include two or more weight ports, generally shown as a third set of weight ports 860 (e.g., shown as weight ports 861, 862, 863, 864, 865, 866, 867, and 868) to form the third visual guide portion 126. In particular, the third visual guide portion 126 may be substantially equidistant from the first and second visual guide portions 122 and 124. For example, the third visual guide portion 126 may extend between the front and rear portions 150 and 160 located at or proximate to a center of the body portion 110. The apparatus, methods, and articles of manufacture described herein are not limited in this regard.

Each weight port of the third set of weight ports 860 may have a third port diameter 870. In one example, the third port diameter 870 may be equal to the first port diameter 850 and/or the second port diameter 855 (e.g., 850=855=870). In another example, the third port diameter 870 may be different from the first port diameter 850 and the second port diameter 855. A uniform distance of less than the third port diameter 870 may separate any two adjacent weight ports of the third set of weight ports 860 (e.g., (i) weight ports 861 and 862, (ii) weight ports 862 and 863, (iii) weight ports 863 and 864, (iv) weight ports 864 and 865, (v) weight ports 865 and 866, (vi) weight ports 866 and 867, or (vii) weight ports 867 and 868). The body portion 110 may also include a U-shape recess portion 190. The third visual guide portion 126 may be located in the U-shape recess portion 190. The apparatus, methods, and articles of manufacture described herein are not limited in this regard.

Figure 9:
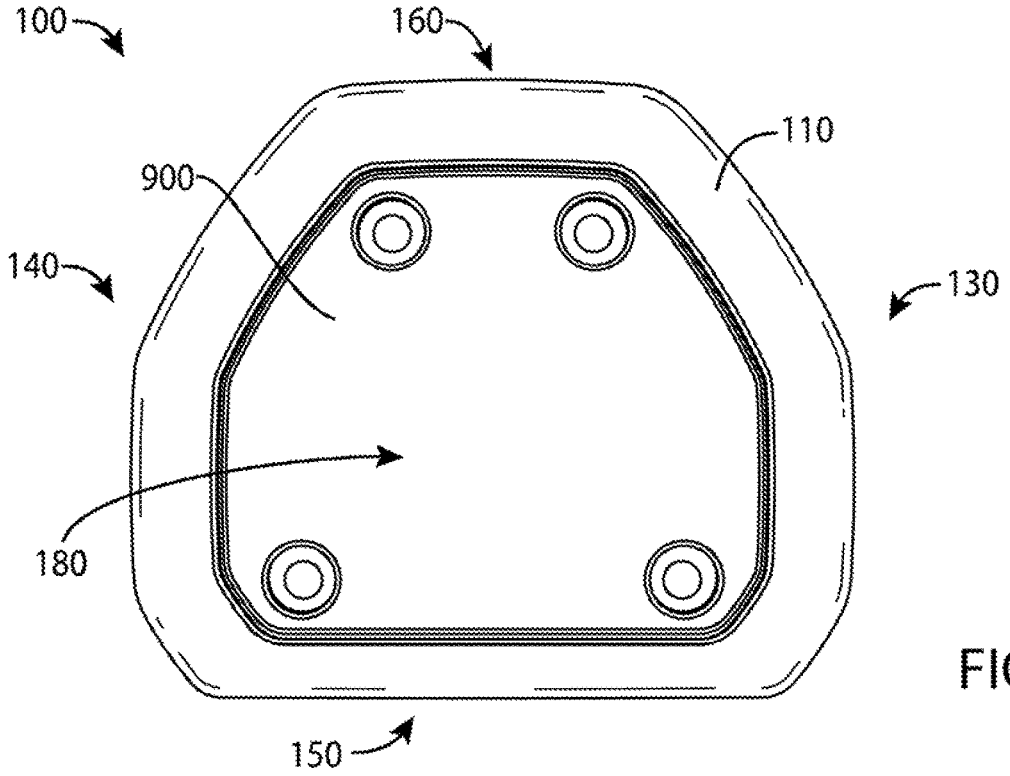
FIG. 9 depicts a bottom view of the example body portion of FIG. 8.

Further, as shown in FIG. 9, the body portion 110 may include an interior cavity 900. The interior cavity 900 may be partially or entirely filled with a polymer material, an elastic polymer or elastomer material, a thermoplastic elastomer material (TPE), a thermoplastic polyurethane material (TPU), and/or other suitable types of materials to absorb shock, isolate vibration, and/or dampen noise. A plate portion 500 (FIG. 5) may cover the interior cavity 900 from the sole portion 180. The plate portion 500 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the plate portion 500 may be partially or entirely made of a non-metal material (e.g., composite, plastic, etc.) with one shown as 1300 in FIG. 13. The apparatus, methods, and articles of manufacture described herein are not limited in this regard.

As illustrated in FIG. 8, the first and second visual guide portions 122 and 124, respectively, may be located a distance from a first vertical plane 880 and a second vertical plane 885, respectively. For example, the first visual guide portion 122 may be located less than one inch (25.4 millimeters) from the first vertical plane 880 and the second visual guide portion 124 may be located less than one inch (25.4 millimeters) from the second vertical plane 885. Further, a distance 400 (FIG. 4) may separate the first and second visual guide portions 122 and 124, which may be greater than a diameter of a golf ball (e.g., 1.68 inches or 42.67 millimeters). In one example, the distance 400 may be greater than three inches (76.2 millimeters). In another example, the distance 400 may be about 3.75 inches (95.25 millimeters). The apparatus, methods, and articles of manufacture described herein are not limited in this regard.

The first and second visual guide portions 122 and 124 may be located relative to the periphery of the golf club head 100. In one example, the first visual guide portion 122 may be located less than 0.5 inch (12.7 millimeters) from the periphery at or proximate to the toe portion 130 whereas the second visual guide portion 124 may be located less than 0.5 inch (12.7 millimeters) from the periphery at or proximate to the heel portion 140. In one example, each of the first and second visual guide portions 122 and 124 may extend about a maximum length 405 between the front and rear portions 150 and 160. In another example, each of the first and second visual guide portions 122 and 124 may extend less than 50% of the maximum length 405 between the front and rear portions 150 and 160. In yet another example, each of the first and second visual guide portions 122 and 124 may extend between 50% and 100% of the maximum length 405 between the front and rear portions 150 and 160. The apparatus, methods, and articles of manufacture described herein are not limited in this regard.

Each of the first and second visual guide portions 122 and 124, respectively, may be dotted lines formed by two or more weight portions, generally shown as a first set of weight portions 420 (e.g., shown as weight portions 421, 422, 423, 424, and 425) and a second set of weight portions 440 (e.g., shown as weight portions 441, 442, 443, 444, and 445). In a similar manner, the third visual guide portion 126 may be a dotted line formed by two or more weight portions, generally shown as a third set of weight portions 460 (e.g., shown as weight portions 461, 462, 463, 464, 465, 466, 467, and 468). The first, second, and third sets of weight portions 420, 440, and 460, respectively, may be partially or entirely made of a high-density material such as a tungsten-based material or suitable types of materials. Alternatively, the first, second, and third sets of weight portions 420, 440, and 460, respectively, may be partially or entirely made of any metal material or non-metal material (e.g., composite, plastic, etc.). The apparatus, methods, and articles of manufacture described herein are not limited in this regard.

Figure 10:
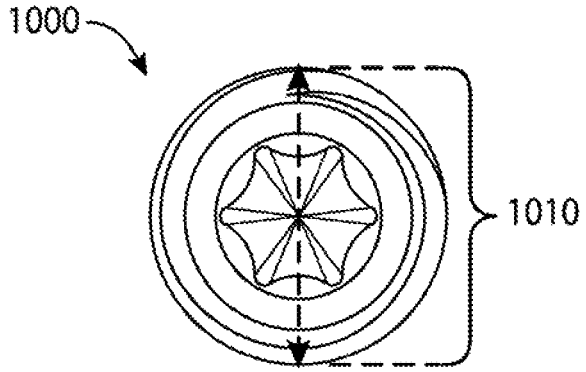
FIG. 10 depicts a top view of a weight portion associated with the example golf club head of FIG. 1.
Figure 11:
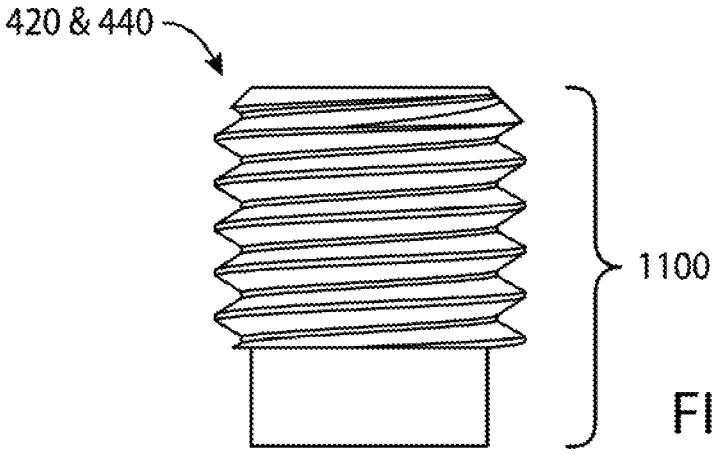
FIG. 11 depicts a side view of a weight portion associated with the example golf club head of FIG. 1.
Figure 12:
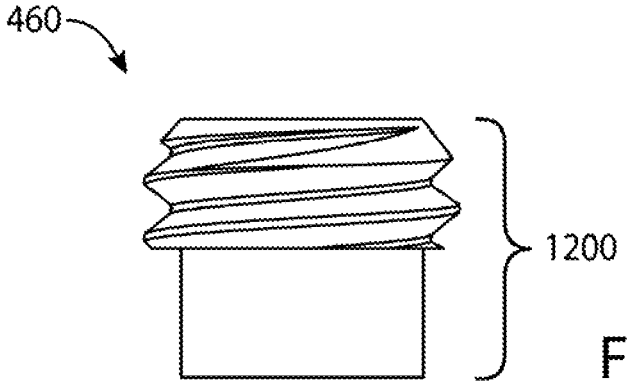
FIG. 12 depicts a side view of another weight portion associated with the example golf club head of FIG. 1.
Figure 13:
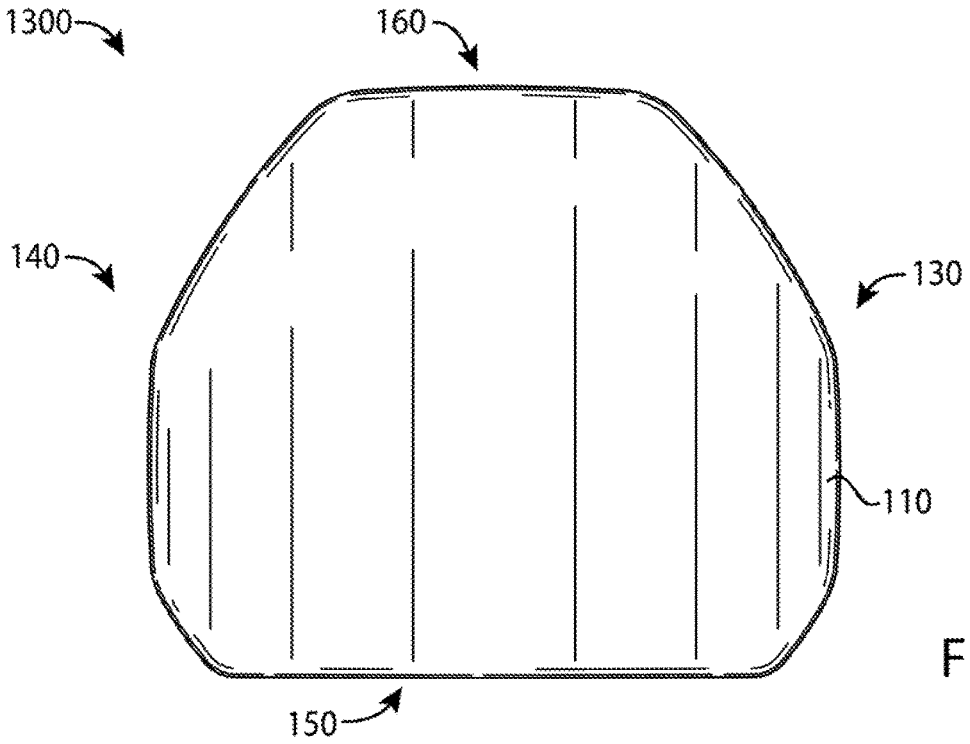
FIG. 13 depicts a bottom view of another example body portion of FIG. 1.

The first, second, and third sets of weight portions 420, 440, and 460, respectively, may have similar or different physical properties (e.g., density, shape, mass, volume, size, color, etc.). In the illustrated example as shown in FIGS. 10-12, each of the weight portions of the first, second, and third sets of weight portions 420, 440, and 460 may have a cylindrical shape (e.g., a circular cross section). Alternatively, each of the weight portions of the first and second sets of weight portions 420 and 440 may have a first shape (e.g., a cylindrical shape) whereas each of the weight portions of the third set of weight portions 460 may have a second shape (e.g., a rectangular shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

Further, each of the weight portions of the first, second, and third sets of weight portions 420, 440, and 460, respectively, may have a diameter 1010 (FIG. 10) of about 0.25 inch (6.35 millimeters) but the first, second, and third sets of weight portions 420, 440, and 460, respectively, may be different in height. In particular, each of the weight portions of the first and second sets of weight portions 420 and 440 may be associated with a first height 1100 (FIG. 11), and each of the weight portions of the third set of weight portions 460 may be associated with a second height 1200 (FIG. 12). The first height 1100 may be relatively longer than the second height 1200. In one example, the first height 1100 may be about 0.3 inch (7.62 millimeters) whereas the second height 1200 may be about 0.16 inch (4.06 millimeters). Alternatively, the first height 1100 may be equal to or less than the second height 1200. The apparatus, methods, and articles of manufacture described herein are not limited in this regard.

The first and second sets of weight portions 420 and 440, respectively, may include threads to secure in the weight ports. For example, each weight portion of the first and second sets of weight portions 420 and 440 may be a screw. The first and second sets of weight portions 420 and 440, respectively, may not be readily removable from the body portion 110 with or without a tool. Alternatively, the first and second sets of weight portions 420 and 440, respectively, may be readily removable (e.g., with a tool) so that a relatively heavier or lighter weight portion may replace one or more of the weight portions of the first and second sets 420 and 440, respectively. In another example, the first and second sets of weight portions 420 and 440, respectively, may be secured in the weight ports of the body portion 110 with epoxy or adhesive so that the first and second sets of weight portions 420 and 440, respectively, may not be readily removable. In yet another example, the first and second sets of weight portions 420 and 440, respectively, may be secured in the weight ports of the body portion 110 with both epoxy and threads so that the first and second sets of weight portions 420 and 440, respectively, may not be readily removable. The apparatus, methods, and articles of manufacture described herein are not limited in this regard.

Figure 4:
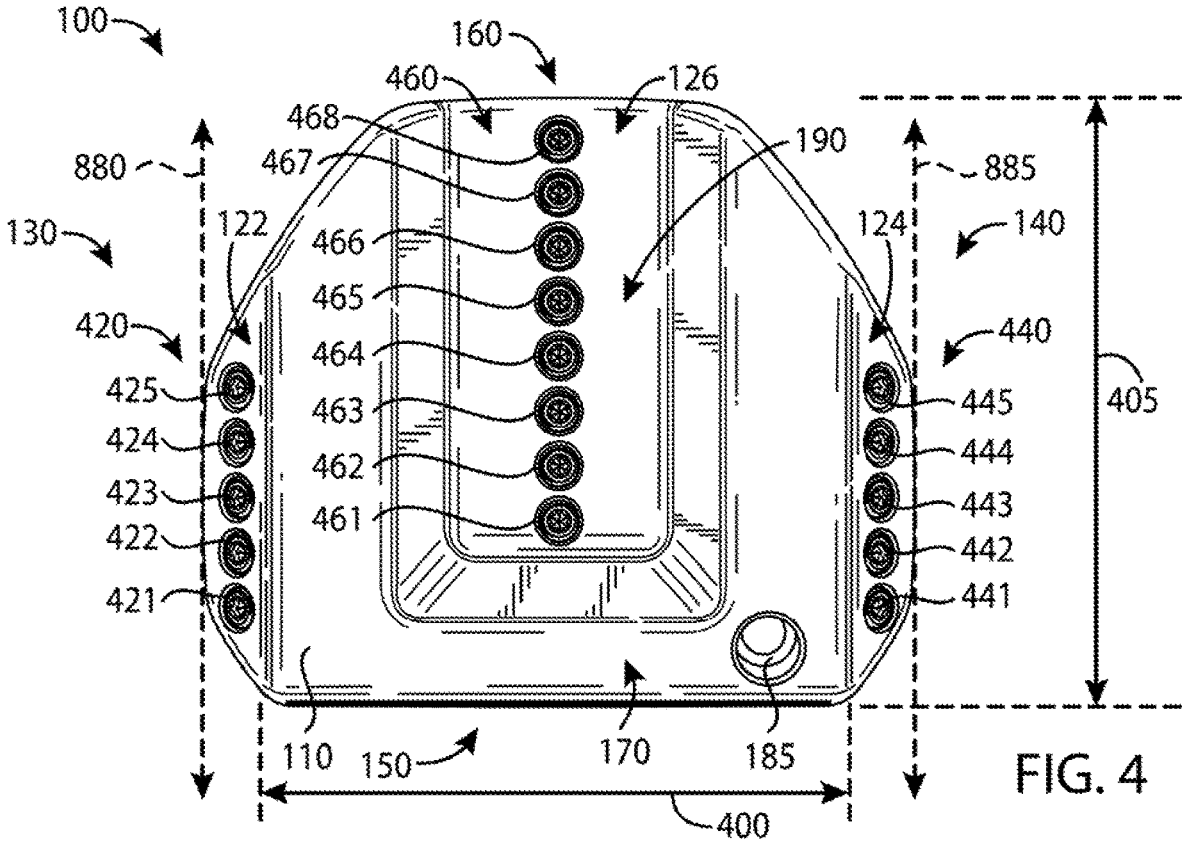
FIG. 4 depicts a top view of the example golf club head of FIG. 1.
Figure 5:
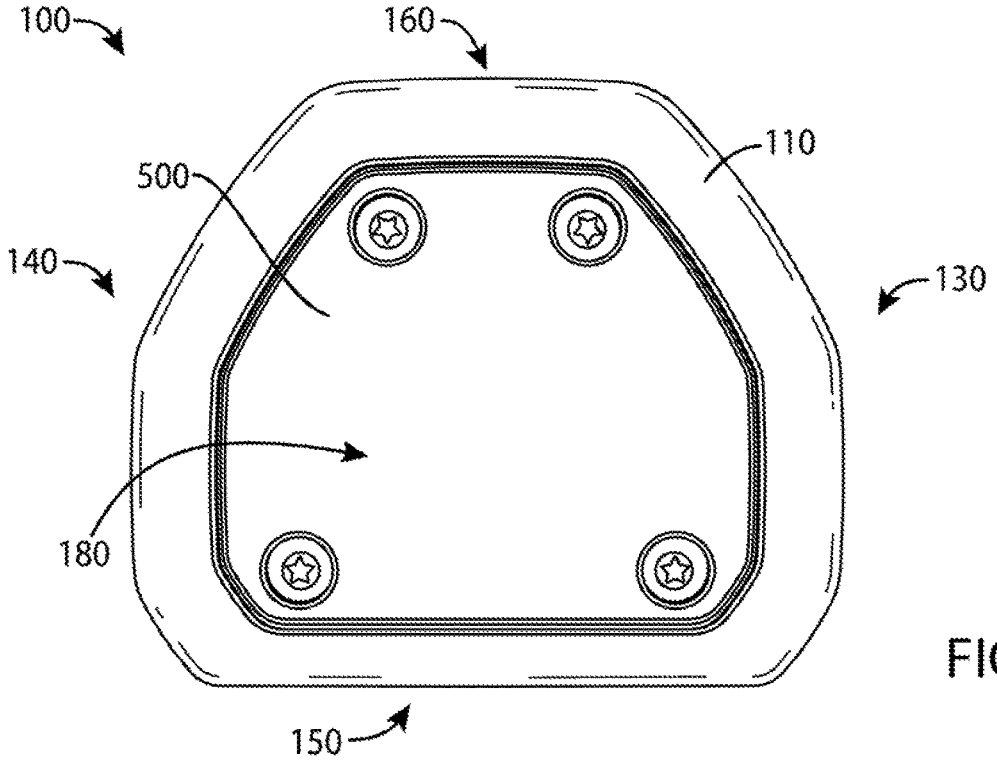
FIG. 5 depicts a bottom view of the example golf club head of FIG. 1.
Figure 6:
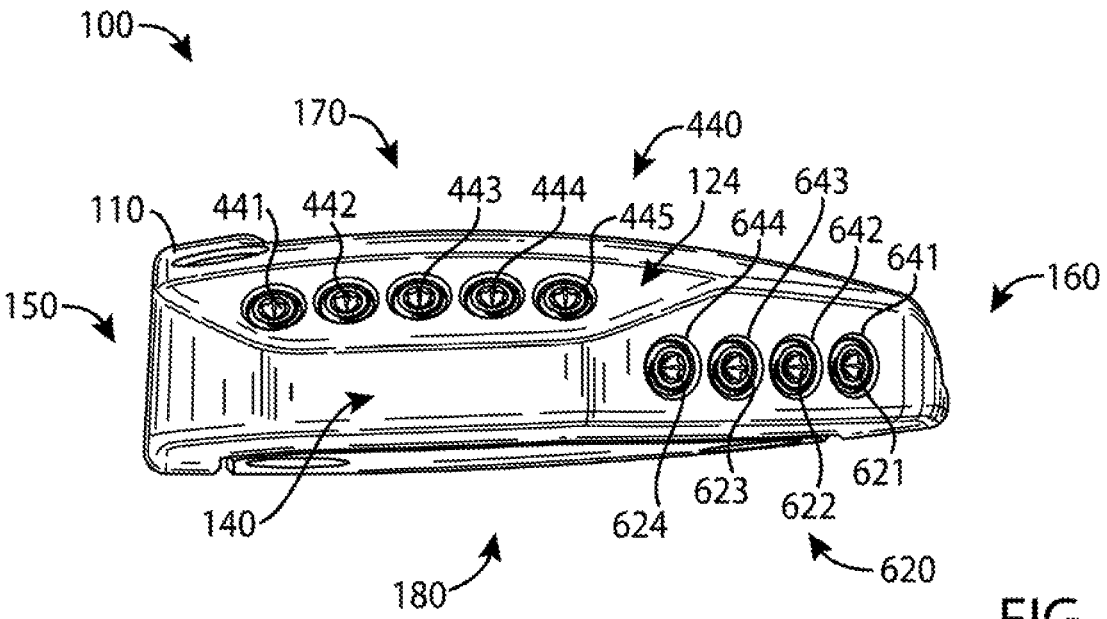
FIG. 6 depicts a left view of the example golf club head of FIG. 1.
Figure 7:
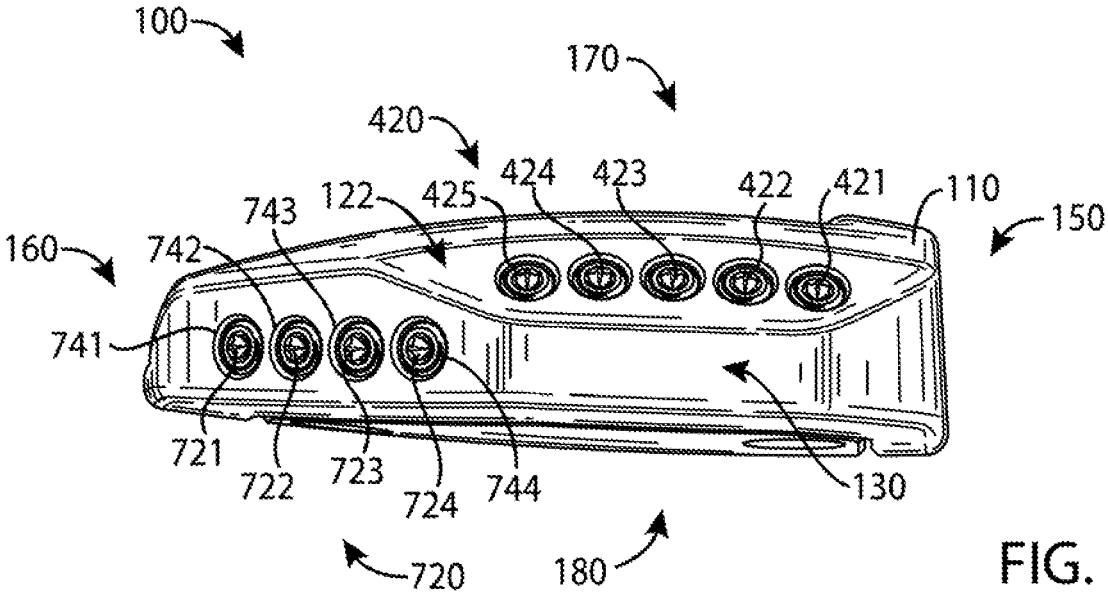
FIG. 7 depicts a right view of the example golf club head of FIG. 1.

As illustrated in FIGS. 6 and 7, the golf club head 100 may also include a fourth set of weight portions 620 (e.g., shown as weight portions 621, 622, 623, and 624) and a fifth set of weight portions 720 (e.g., shown as weight portions 721, 722, 723, and 724). Although both the fourth and fifth sets of weight portions 620 and 720 may be located at or proximate to the rear portion 160, the fourth set of weight portions 620 may be located at or proximate to the heel portion 140 whereas the fifth set of weight portions 720 may be at or proximate to the toe portion 130. Each of the fourth and fifth sets of weight portions 620 and 720 may include at least three weight portions. Each weight portion of the fourth and fifth sets of weight portions 620 and 720 may be coupled (e.g., via threads) to a corresponding weight port (e.g., shown as weight ports 641, 642, 643, 644, 741, 742, 743, and 744) on the periphery of the body portion 110. The corresponding weight ports may be spaced apart and have port diameters similar or different to any one or more of the first, second, and third port diameters 850, 855, and 870 associated with the first, second, and third sets of weight ports 820, 840, and 860. In one example, as shown in FIG. 4, the fourth and fifth sets of weight portions 620 and 720 and the corresponding weight ports may not be visible when the club head 100 is directly viewed from the top. The apparatus, methods, and articles of manufacture described herein are not limited in this regard.

Figure 14:
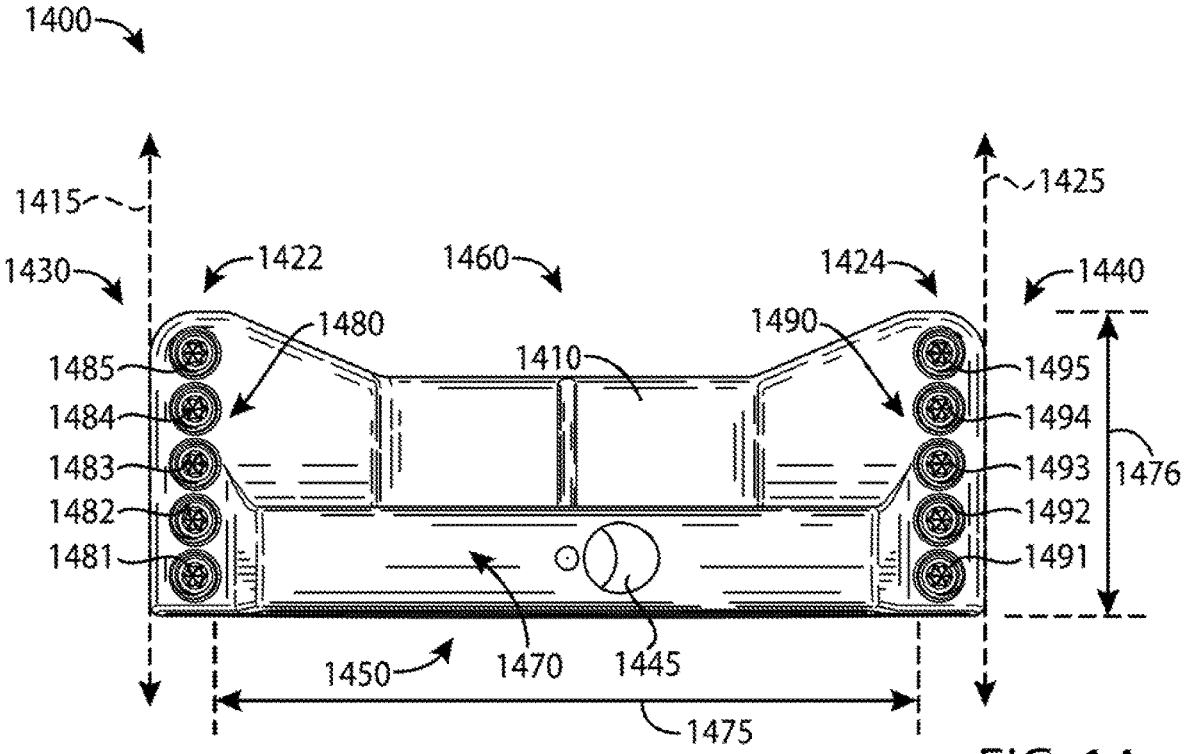
FIG. 14 depicts a top view of a golf club head according to another example of the apparatus, methods, and articles of manufacture described herein.

Although the above examples may describe a particular number of visual guide portions, weight ports, and weight portions, the apparatus, methods, and articles of manufacture described herein may include more or less visual guide portions, weight ports, and/or weight portions. While the golf club head 100 illustrated in FIGS. 1-9 may depict a particular type of putter club head (e.g., a mallet-type putter club head), the apparatus, methods, and articles of manufacture described herein may be applicable to other types of putters. For example, as illustrated in FIG. 14, the apparatus, methods, and articles of manufacture described herein may be applicable to a blade-type putter golf club head 1400. The golf club head 1400 may include a body portion 1410, and a visual guide portion, generally shown as a first visual guide portion 1422 and a second visual guide portion 1424. The body portion 1410 may include a toe portion 1430, a heel portion 1440, a front portion 1450, a rear portion 1460, a sole portion (not shown), and a top portion 1470. The body portion 1410 may also include a bore 1445 to receive a shaft (not shown). Alternatively, the body portion 1410 may include a hosel (not shown) to receive a shaft. The body portion 1410 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 1410 may be partially or entirely made of a non-metal material (e.g., composite, plastic, etc.). The apparatus, methods, and articles of manufacture described herein are not limited in this regard.

The first and second visual guide portions 1422 and 1424, respectively, may be located a particular distance from a first vertical plane 1415 and a second vertical plane 1425, respectively. For example, the first visual guide portion 1422 may be located less than one inch (25.4 millimeters) from the first vertical plane 1415 and the visual guide portion 1424 may be located less than one inch (25.4 millimeters) from the second vertical plane 1425. Further, a distance 1475 may separate the first and second visual guide portions 1422 and 1424, which may be greater than a diameter of a golf ball. In one example, the distance 1475 may be greater than three inches (76.2 millimeters). In another example, the distance 1475 may be about 3.75 inches (95.25 millimeters).

The first and second visual guide portions 1422 and 1424 may be located relative to a periphery of the golf club head 1400. In one example, the first visual guide portion 1422 may be located less than 0.5 inch (12.7 millimeters) from the periphery at or proximate to the toe portion 1430 whereas the second visual guide portion 1424 may be located less than 0.5 inch (12.7 millimeters) from the periphery at or proximate to the heel portion 1440. In one example, each of the first and second visual guide portions 1422 and 1424 may extend about a maximum length 1476 between the front and rear portions 1450 and 1460. In another example, each of the first and second visual guide portions 1422 and 1424 may extend less than 50% of the maximum length 1476 between the front and rear portions 1450 and 1460. In yet another example, each of the first and second visual guide portions 1422 and 1424 may extend between 50% and 100% of the maximum length 1476 between the front and rear portions 1450 and 1460. The apparatus, methods, and articles of manufacture described herein are not limited in this regard.

Each of the first and second visual guide portions 1422 and 1424, respectively, may be dotted lines formed by two or more weight portions, generally shown as a first set of weight portions 1480 (e.g., shown as weight portions 1481, 1482, 1483, 1484, and 1485) and a second set of weight portions 1490 (e.g., shown as weight portions 1491, 1492, 1493, 1494, and 1495). The first and second sets of weight portions 1480 and 1490, respectively, may be partially or entirely made of a high-density material such as a tungsten-based material or suitable types of materials. Alternatively, the first and second sets of weight portions 1480 and 1490, respectively, may be partially or entirely made of a non-metal material (e.g., composite, plastic, etc.). The apparatus, methods, and articles of manufacture described herein are not limited in this regard.

The first and second sets of weight portions 1480 and 1490, respectively, may have similar or different physical properties (e.g., density, shape, mass, volume, size, color, etc.). In the illustrated example as shown in FIGS. 10-12, each of the weight portions of the first and second sets of weight portions 1480 and 1490 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

The first and second sets of weight portions 1480 and 1490, respectively, may include threads to secure in the weight ports, which may also have corresponding threads. For example, each weight portion of the first and second sets of weight portions 1480 and 1490 may be a screw. The first and second sets of weight portions 1480 and 1490, respectively, may not be readily removable from the body portion 1410 with or without a tool. Alternatively, the first and second sets of weight portions 1480 and 1490, respectively, may be readily removable (e.g., with a tool) so that a relatively heavier or lighter weight portion may replace one or more of the weight portions of the first and second sets of weight portions 1480 and 1490, respectively. In another example, the first and second sets of weight portions 1480 and 1490, respectively, may be secured in the weight ports of the body portion 1410 with epoxy or adhesive so that the first and second sets of weight portions 1480 and 1490, respectively, may not be readily removable. In yet another example, the first and second sets of weight portions 1480 and 1490, respectively, may be secured in the weight ports of the body portion 1410 with both epoxy and threads so that the first and second sets of weight portions 1480 and 1490, respectively, may not be readily removable. The apparatus, methods, and articles of manufacture described herein are not limited in this regard.

Figure 15:
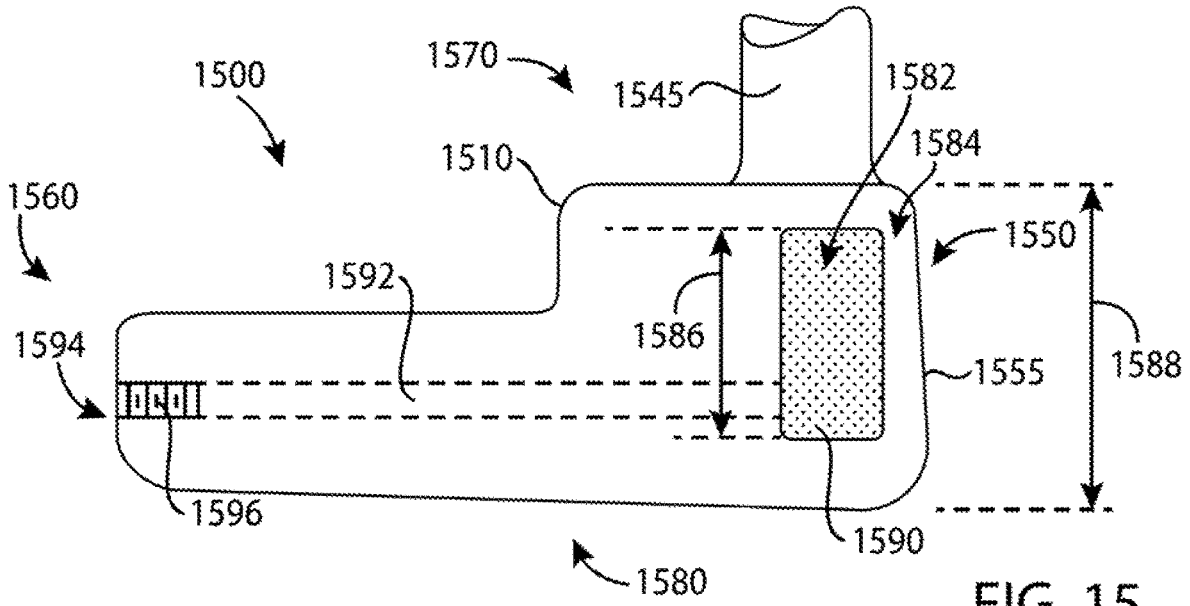
FIG. 15 depicts a schematic cross-sectional view of a golf club head according to yet another example of the apparatus, methods and articles of manufacture described herein.
Figure 16:
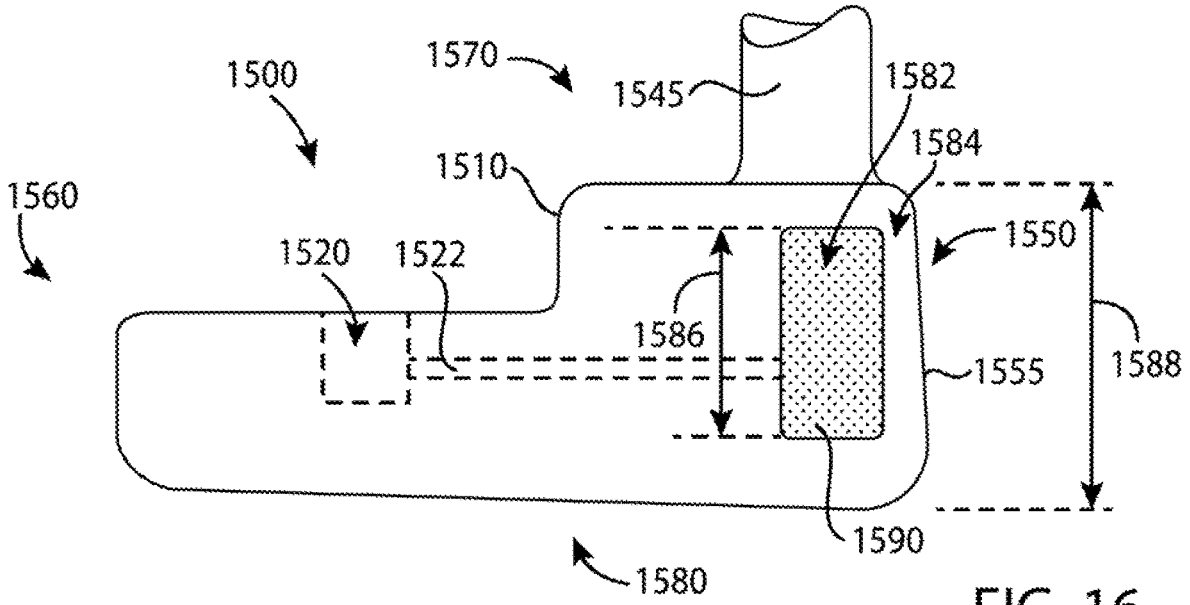
FIG. 16 depicts a schematic cross-sectional view of another example of the golf club head of FIG. 15.

In the example of FIGS. 15 and 16, a golf club head 1500 may include a body portion 1510. The body portion 1510 may include a toe portion (not shown), a heel portion (not shown), a front portion 1550, a rear portion 1560, a top portion 1570, and a sole portion 1580. The body portion 1510 may be manufactured via various manufacturing methods and/or processes (e.g., a casting process, a forging process, a milling process, a cutting process, a grinding process, a welding process, a combination thereof, etc.). The body portion 1510 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1510 may be partially or entirely made of non-metal material (e.g., composite, plastic, etc.). The golf club head 1500 may be a putter-type golf club head (e.g., a blade-type putter, a mid-mallet-type putter, a mallet-type putter, etc.). Based on the type of putter as mentioned above, the body portion 1510 may be at least 200 grams. For example, the body portion 1510 may be in a range between 300 to 600 grams. Although FIGS. 15 and 16 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1510 may include a hosel portion 1545 configured to receive a shaft (not shown) with a grip (not shown). The golf club head 1500 and the grip may be located on opposite ends of the shaft to form a golf club. The front and rear portions 1550 and 1560, respectively, may be on opposite ends of the body portion 1510. The front portion 1550 may include a face portion 1555 (e.g., a strike face). The face portion 1555 may be used to impact a golf ball. The face portion 1555 may be an integral portion of the body portion 1510. Alternatively, the face portion 1555 may be a separate piece or an insert coupled to the body portion 1510 via various manufacturing methods and/or processes (e.g., a bonding process, a welding process, a brazing process, a mechanical locking method, a mechanical fastening method, any combination thereof, or other suitable types of manufacturing methods and/or processes). The face portion 1555 may be associated with a loft plane that defines the loft angle of the golf club head 1500. The apparatus, methods, and articles of manufacture described herein are not limited in this regard.

The body portion 1510 may include one or more weight ports and one or more weight portions similar to any of the golf club heads described herein. For example, a weight port 1520 is shown in FIG. 16. For example, the body portion 1510 may include a first set of weight ports (not shown) similar to the first set of weight ports 820 of the golf club head 100 and a second set of weight ports (not shown) similar to the second set of weight ports 840 of the golf club head 100 that are configured to receive a plurality of weight portions. Accordingly, a detailed description of the weight ports and weight portions of the golf club 1500 is not described. Alternatively, the body portion 1510 may not include any weight ports and/or weight portions.

The body portion 1510 may be a hollow body including an interior cavity 1582 extending between the front portion 1550 and the rear portion 1560. Further, the interior cavity 1582 may extend between the top portion 1570 and the sole portion 1580. A cavity wall portion 1584 may separate the interior cavity 1582 and the face portion 1555. The interior cavity 1582 may be associated with a cavity height 1586 ($H_C$) and the body portion 1510 may be associated with a body height 1588 ($H_B$). While the cavity height 1586 and the body height 1588 may vary between the toe and heel portions, the cavity height 1586 may be at least 50% of the body height 1588 ($H_C > 0.5 * H_B$). For example, the cavity height 1586 may vary between 70% and 85% of the body height 1588. With the cavity height 1586 of the interior cavity 1582 being greater than 50% of the body height 1588, the golf club head 1500 may produce relatively more consistent feel, sound, and/or result when the golf club head 1500 strikes a golf ball via the face portion 1555 than a golf club head with a cavity height of less than 50% of the body height. However, the cavity height 1586 may be less than 50% of the body height 1588. The apparatus, methods, and articles of manufacture described herein are not limited in this regard.

In one example, the interior cavity 1582 may be unfilled (i.e., empty space). Alternatively, the interior cavity 1582 may be partially or entirely filled with a filler material (e.g., generally shown as 1590). The filler material 1590 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1582 may be filled with a TPE material to absorb shock, isolate vibration, and/or dampen noise when the golf club head 1500 strikes a golf ball via the face portion 1555. The apparatus, methods, and articles of manufacture described herein are not limited in this regard.

In another example, the filler material 1590 may be a polymer material such as an ethylene copolymer material to absorb shock, isolate vibration, and/or dampen noise when the golf club head 1500 strikes a golf ball via the face portion 1555. In particular, at least 50% of the interior cavity 1582 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material 1590 may be injected into the interior cavity 1582 by an injection molding process via a port 1592 on the body portion 1510 as shown in FIG. 15. The port 1592 may have an opening 1594 on the body portion 1510 to allow injection of the filler material into the interior cavity 1582 through the port 1592. The port 1592 may have a plug 1596, by which the opening 1594 may be closed after injection of the filler material 1590 into the interior cavity 1582. Alternatively, as shown in the example of FIG. 16, at least one of the weight ports (e.g., 1520) on the body portion 1510 may be connected to the interior cavity 1582 through a connection port 1522 that may be similar to the port 1592. Accordingly, the filler material may be injected into the interior cavity 1582 from the at least one weight port (e.g., 1520) through the connection port 1522. The apparatus, methods, and articles of manufacture described herein are not limited in this regard.

For example, at least 50% of the interior cavity 1582 may be filled with a TPE material to absorb shock, isolate vibration, dampen noise, and/or provide structural support when the golf club head 1500 strikes a golf ball via the face portion 1555. With the support of the cavity wall portion 1584 and filling at least a portion of the interior cavity 1582 with an elastic polymer material, the face portion 1555 may be relatively thin without degrading the structural integrity, sound, and/or feel of the golf club head 1500. In one example, the face portion 1555 may have a thickness of less than or equal to 0.075 inch or 1.905 millimeters (e.g., the thickness of the cavity wall portion 1584). In another example, the face portion 1555 may have a thickness of less than or equal to 0.060 inch (1.524 millimeters). In yet another example, the face portion 1555 may have a thickness of less than or equal to 0.050 inch (1.270 millimeters). Further, the face portion 1555 may have a thickness of less than or equal to 0.030 inch (0.762 millimeters). The apparatus, methods, and articles of manufacture described herein are not limited in this regard.

Figure 17:
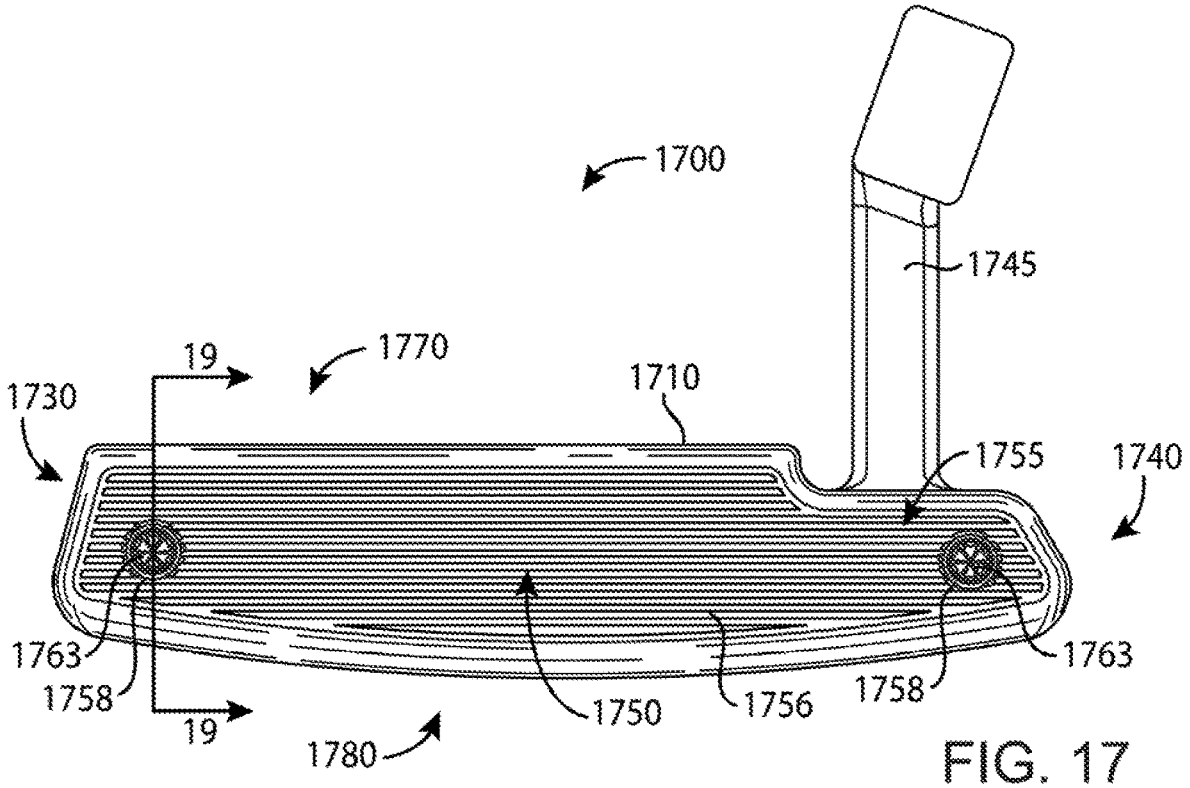
FIG. 17 depicts a front view of a golf club head according to yet another example of the apparatus, methods, and articles of manufacture described herein.
Figure 18:
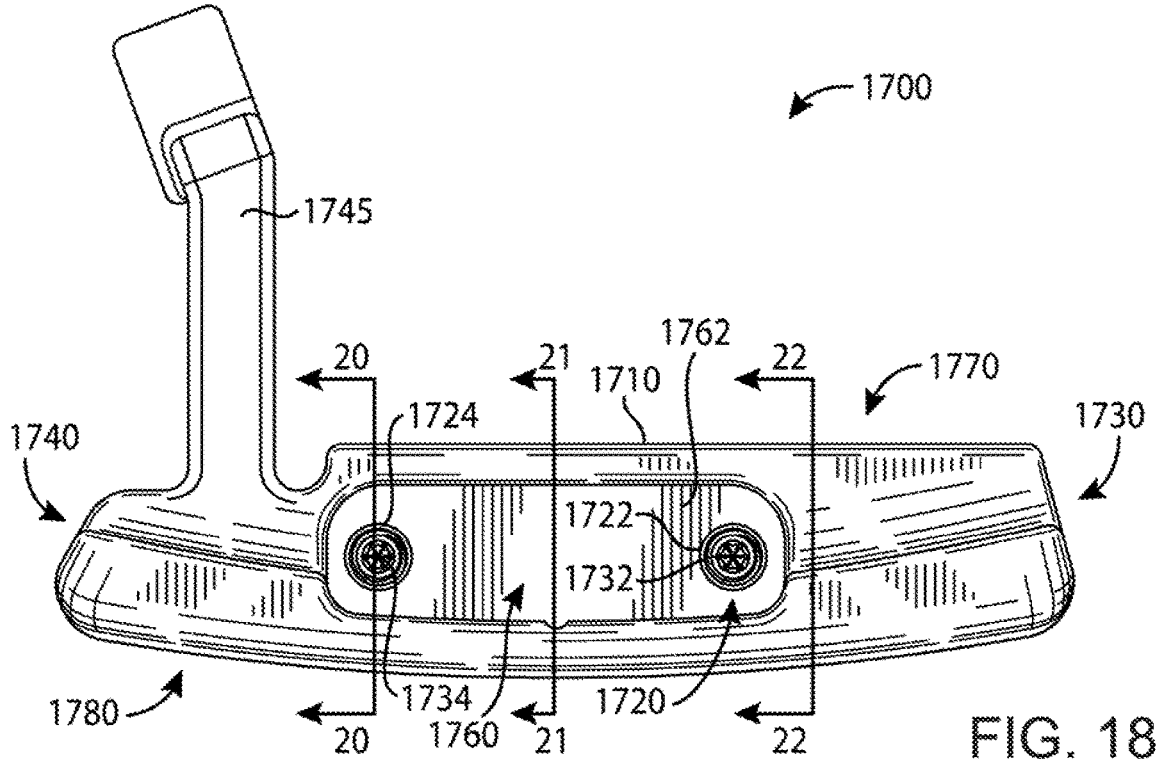
FIG. 18 depicts a rear view of the golf club head of FIG. 17.
Figure 19:
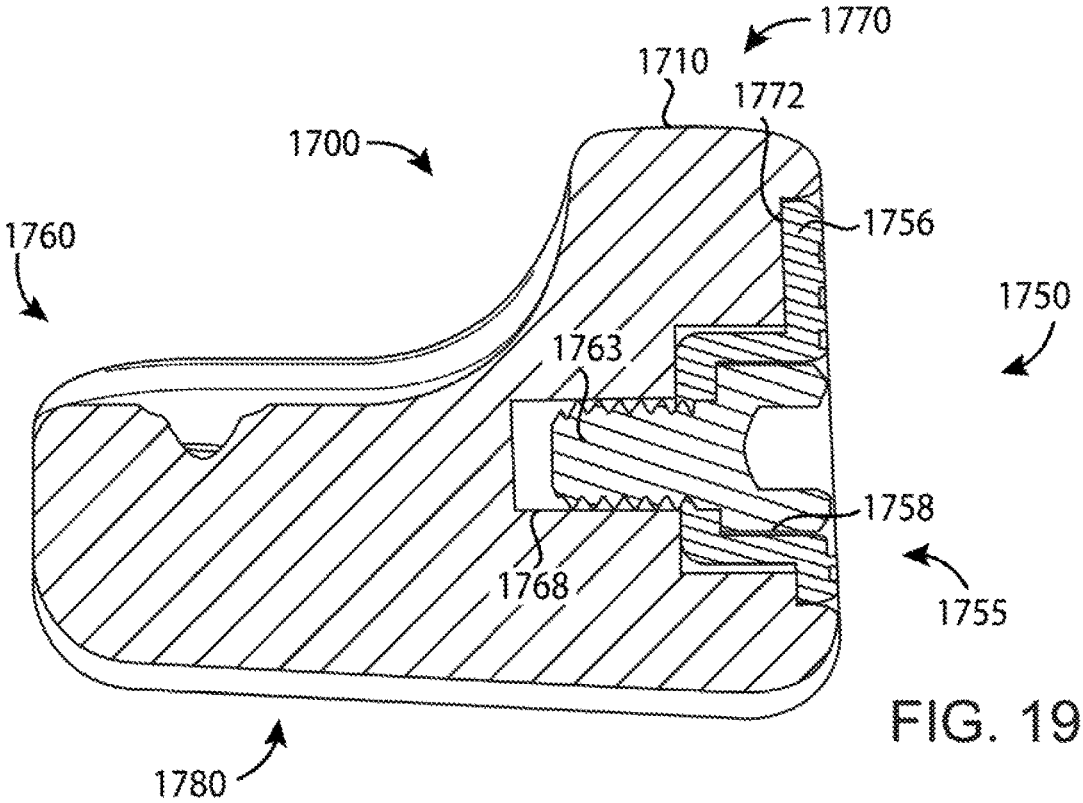
FIG. 19 depicts a cross-sectional view of the golf club head of FIG. 17 at lines 19-19 of FIG. 17.

In the example of FIGS. 17 and 18, a golf club head 1700 may include a body portion 1710. The body portion 1710 may include a toe portion 1730, a heel portion 1740, a front portion 1750, a rear portion 1760, a top portion 1770, and a sole portion 1780. The body portion 1710 may be manufactured via various manufacturing methods and/or processes (e.g., a casting process, a forging process, a milling process, a cutting process, a grinding process, a welding process, a combination thereof, etc.). The body portion 1710 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1710 may be partially or entirely made of non-metal material (e.g., composite, plastic, etc.). The golf club head 1700 may be a putter-type golf club head (e.g., a blade-type putter, a mid-mallet-type putter, a mallet-type putter, etc.). Based on the type of putter as mentioned above, the body portion 1710 may be at least 200 grams. For example, the body portion 1710 may be in a range between 300 to 600 grams. Although FIGS. 17 and 18 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1710 may include a hosel portion 1745 configured to receive a shaft (not shown) with a grip (not shown). The golf club head 1700 and the grip may be located on opposite ends of the shaft to form a golf club. The front and rear portions 1750 and 1760, respectively, may be on opposite ends of the body portion 1710. The front portion 1750 may include a face portion 1755 (e.g., a strike face). The face portion 1755 may be used to impact a golf ball. The face portion 1755 may be associated with a loft plane that defines the loft angle of the golf club head 1700. The apparatus, methods, and articles of manufacture described herein are not limited in this regard.

The body portion 1710 may include one or more weight ports and one or more weight portions similar to any of the golf club heads described herein. For example, the body portion 1710 may include a first set of weight ports 1720 at or proximate the rear portion 1760. In the examples of FIGS. 17-22, the rear portion 1760 may include a back wall portion 1762 having a first weight port 1722 of the first set of weight ports 1720 and a second weight port 1724 of the first set of weight ports 1720. The first weight port 1722 may be closer to the toe portion 1730 than the second weight port 1724. The second weight port 1724 may be closer to the heel portion 1740 than the first weight port 1722. The first and second weight ports 1722 and 1724, respectively, may be at any location on the back wall portion 1762 or the rear portion 1760. Alternatively, the body portion 1710 may not include any weight ports on the back wall portion 1762. The apparatus, methods, and articles of manufacture described herein are not limited in this regard.

Figure 20:
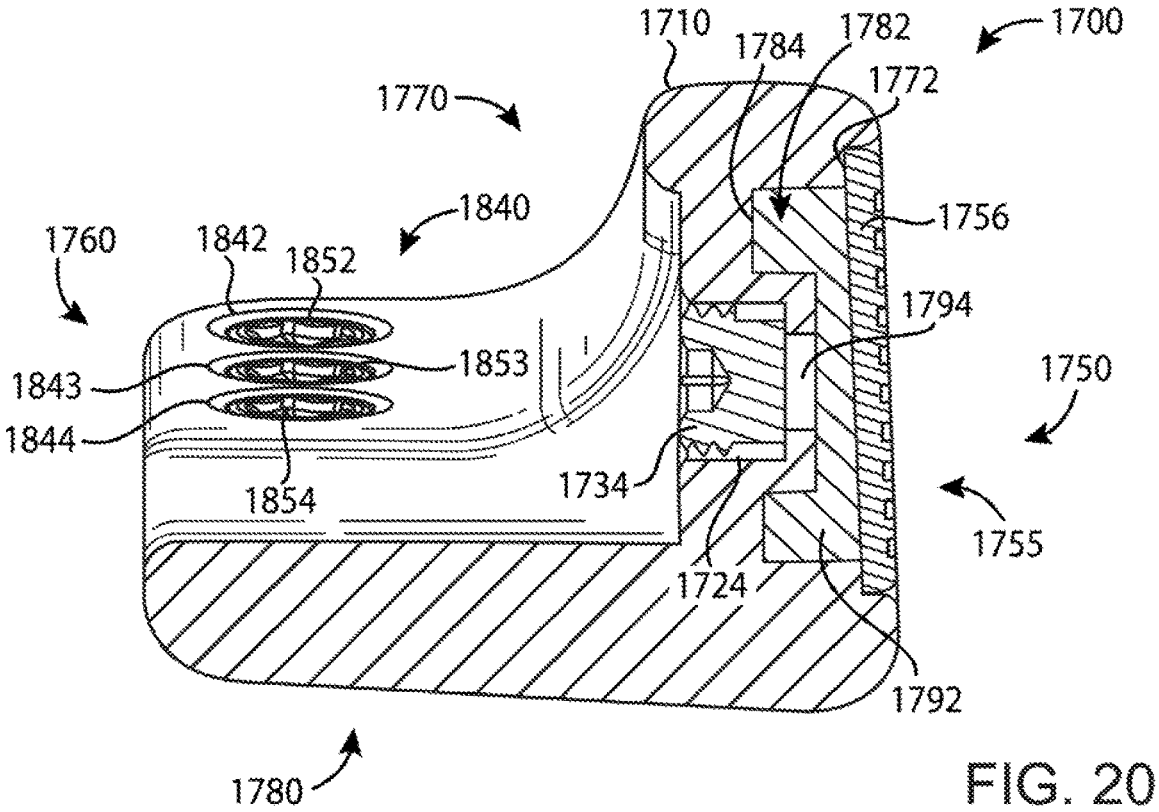
FIG. 20 depicts a cross-sectional view of the golf club head of FIG. 17 at lines 20-20 of FIG. 18.

In the example of FIGS. 17-22, the body portion 1710 may include a second set of weight ports 1840 as shown in FIG. 20 proximate to the heel portion 1740 and extending between the toe portion 1730 and the heel portion 1740. The second set of weight ports 1840 may include any number of weight ports, such as three weight ports as shown in FIG. 20 as weight ports 1842, 1843, and 1844. The body portion 1710 may include a third set of weight ports 1860 that may be located near the toe portion 1730 and extend between the toe portion 1730 and the heel portion 1740. The third set of weight ports 1860 may include any number of weight ports, such as three weight ports similar to the weight ports of the second set of weight ports 1840. The second and third sets of weight ports 1840 and 1860, respectively, may be similar to each other and symmetrically arranged relative to a midpoint of the body portion 1710. The apparatus, methods, and articles of manufacture described herein are not limited in this regard.

Figure 22:
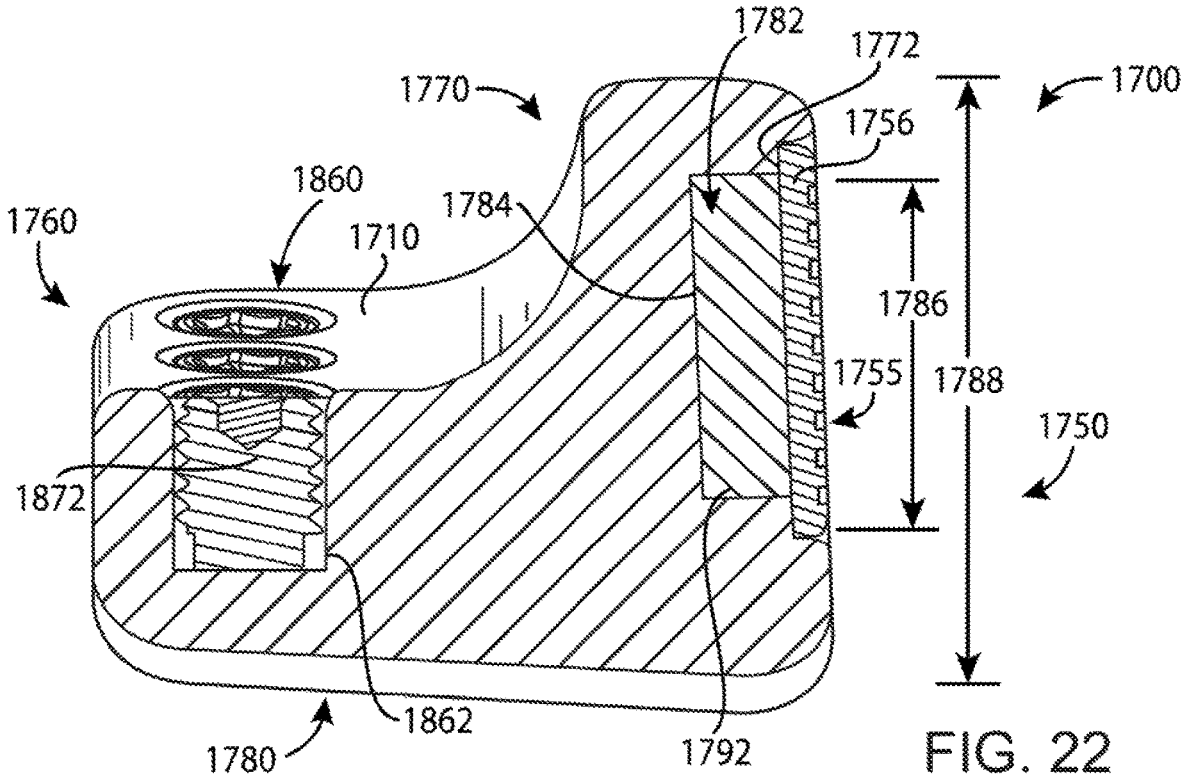
FIG. 22 depicts a cross-sectional view of the golf club head of FIG. 17 at lines 22-22 of FIG. 18.

The golf club head 1700 may include a plurality of weight portions. Each weight port of the first, second, and third sets of weight ports 1720, 1840, and 1860 may be configured to receive a weight portion. For example, the first and second weight ports 1722 and 1724 of the first set of weight ports 1720 may receive weight portions 1732 and 1734, respectively. The weight ports 1842, 1843, and 1844 of the second set of weight ports 1840 may receive weight portions 1852, 1853, and 1854, respectively. The weight ports of the third set of weight ports 1860 may receive weight portions similar to the second set of weight ports 1840. In the example of FIG. 22, a weight port 1862 of the third set of weight ports 1860 is shown to have received a weight portion 1872. The configurations of the weight ports and the weight portions (e.g., inner diameter, outer diameter, size, shape, distance from an adjacent weight port or weight portion, etc.) of the golf club head 1700 may be similar in many respects to the weight ports and weight portions of any of the golf club heads descried herein. Accordingly, a detailed description of the weight ports and weight portions of the golf club 1700 is not described. Alternatively, the body portion 1710 may not include any weight ports and/or weight portions. The apparatus, methods, and articles of manufacture described herein are not limited in this regard.

In the example of FIGS. 17-22, the face portion 1755 may include a separate piece or an insert coupled to the body portion 1710. The face portion 1755 may include a face insert 1756, which may be attached to the front portion 1750 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 17 and 19, the face insert 1756 may include two fastener holes 1758 proximate to the toe portion and heel portion of the face insert 1756. Each of the fastener holes 1758 may be configured to receive a fastener 1763 for attachment of the face insert 1756 to the body portion 1710. The body portion 1710 may include two fastener ports 1768 (one fastener port 1768 shown in FIG. 19) configured to receive the fasteners 1763. Each fastener port 1768 may have internal threads that are configured to engage external threads on the fasteners 1763. The apparatus, methods, and articles of manufacture described herein are not limited in this regard.

The face portion 1755 may include a peripheral recessed portion 1772 configured to receive the face insert 1756. As shown by example in FIGS. 19-22, the depth of the peripheral recessed portion 1772 may be similar to the thickness of the face insert 1756 such that when the face insert 1756 is fastened to the body portion 1710, the face insert 1756 is positioned flush or substantially flush with the face portion 1755. Alternatively, the face insert 1756 may project from the face portion 1755. The apparatus, methods, and articles of manufacture described herein are not limited in this regard.

The fasteners 1763 may have similar or different weights to balance and/or provide heel or toe weight bias for the golf club 1700. For example, the weight of the body portion 1710 may be increased or decreased by similarly increasing or decreasing, respectively, the weights of the fasteners 1763. In one example, the golf club head 1700 may be provided with a toe-biased weight configuration by having the fastener 1763 that is closer to the toe portion 1730 be heavier than the fastener 1763 that is closer to the heel portion 1740. Conversely, the golf club head 1700 may be provided with a heel-biased weight configuration by having the fastener 1763 that is closer to the heel portion 1740 be heavier than the fastener 1763 that is closer to the toe portion 1730. The apparatus, methods, and articles of manufacture described herein are not limited in this regard.

To attach the face insert 1756 to the body portion 1710, the face insert 1756 may be inserted in the peripheral recessed portion 1772, thereby generally aligning the fastener holes 1758 of the face insert 1756 and the fastener ports 1768 of the body portion 1710. The fasteners 1763 can be inserted through the fastener holes 1758 and screwed into the fastener ports 1768 to securely attach the face insert 1756 to the body portion 1710. The face insert 1756 may be constructed from any material such as metal, metal alloys, plastic, wood, composite materials or a combination thereof to provide a certain ball striking characteristic to the golf club head 1700. The material from which the face insert 1756 is manufactured may affect ball speed and spin characteristics. Accordingly, the face insert 1756 may be selected to provide a certain ball speed and spin characteristics for an individual. Thus, the face insert 1756 may be interchangeable with other face inserts having different ball speed and spin characteristics. The face insert 1756 may be coupled to the body portion 1710 by other methods or devices, such as by bonding, welding, adhesive and/or other types of fastening devices and/or methods. The apparatus, methods, and articles of manufacture described herein are not limited in this regard.

Figure 21:
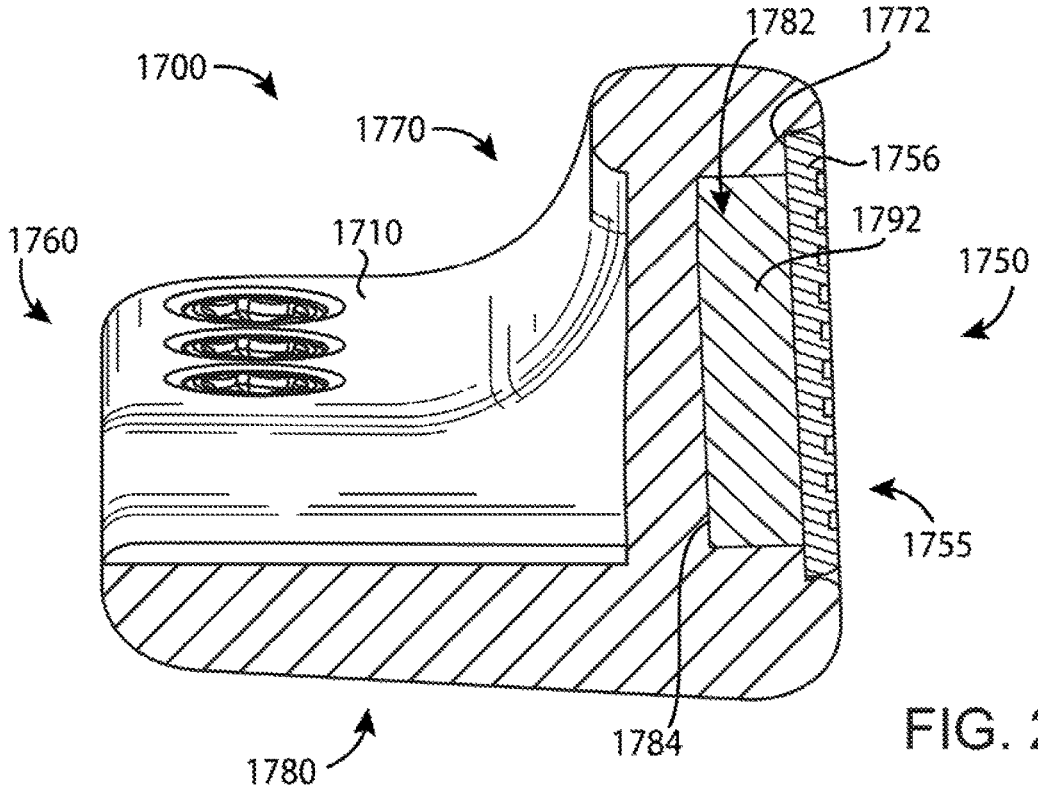
FIG. 21 depicts a cross-sectional view of the golf club head of FIG. 17 at lines 21-21 of FIG. 18.

The body portion 1710 may include an interior cavity 1782 extending between the front portion 1750 and the rear portion 1760 and between the toe portion 1730 and the heel portion 1740. In one example as shown in FIGS. 20-22, the interior cavity 1782 may be defined by a recess 1784 in the front portion 1750 that is covered by the face insert 1756. The recess 1784 may extend from near the toe portion 1730 to near the heel portion 1740 and from near the top portion 1770 to near the sole portion 1780. Alternatively, the recess 1784 may extend between the fastener ports 1768 of the body portion 1710. In one example, the recess 1784 may be located in and/or near the regions of the face portion 1755 that generally strike a golf ball. The apparatus, methods, and articles of manufacture described herein are not limited in this regard.

The interior cavity 1782 may be associated with a cavity height 1786 ($H_C$) and the body portion 1710 may be associated with a body height 1788 ($H_B$). While the cavity height 1786 and the body height 1788 may vary between the toe and heel portions 1730 and 1740, the cavity height 1786 may be at least 50% of a body height 1788 ($H_C$>0.5*$H_B$). For example, the cavity height 1786 may vary between 70% and 85% of the body height 1788. With the cavity height 1786 of the interior cavity 1782 being greater than 50% of the body height 1788, the golf club head 1700 may produce relatively more consistent feel, sound, and/or result when the golf club head 1700 strikes a golf ball via the face portion 1755 than a golf club head with a cavity height of less than 50% of the body height. However, the cavity height 1786 may be less than 50% of the body height 1788. The apparatus, methods, and articles of manufacture described herein are not limited in this regard.

In one example, the interior cavity 1782 may be unfilled (i.e., empty space). Alternatively, the interior cavity 1782 may be partially or entirely filled with a filler material 1792 to absorb shock, isolate vibration, and/or dampen noise when the face portion 1755 strikes a golf ball. The filler material 1792 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1782 may be filled with a TPE material to absorb shock, isolate vibration, and/or dampen noise when the golf club head 1700 strikes a golf ball via the face portion 1755. The apparatus, methods, and articles of manufacture described herein are not limited in this regard.

In another example, the filler material 1792 may be a polymer material such as an ethylene copolymer material to absorb shock, isolate vibration, and/or dampen noise when the golf club head 1700 strikes a golf ball via the face portion 1755. In particular, at least 50% of the interior cavity 1782 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 1782 may be partially or fully filled with the filler material 1792. In one example, the recess 1784 may be filled with the filler material 1792 prior to attaching the face insert 1756 to the face portion 1755. In one example, the interior cavity 1782 may be filled with the filler material 1792 via any one of the first and second weight ports 1722 or 1724 of the first set of weight ports 1720. In one example as shown in FIG. 20, the second weight port 1724 may be connected to the interior cavity 1782 via an opening 1794. Similarly, the first weight port 1722 may be connected to the interior cavity 1782 via an opening (not shown). The filler material 1792 may be injected in the interior cavity 1782 from the second weight port 1724 via the opening 1794. As the filler material 1792 fills the interior cavity 1782, the air inside the interior cavity 1782 that is displaced by the filler material 1792 may exit the interior cavity 1782 from the first weight port 1722 through the opening (not shown) that connects the first weight port 1722 to the interior cavity 1782. Accordingly, the first weight port 1722 may function as an exit port for the displaced air inside the interior cavity 1782. After the interior cavity 1782 is partially or fully filled with the filler material 1792, the first and second weight ports 1722 and 1724 may be closed by inserting and securing weight portions 1732 and 1734, respectively, therein as described in detail herein. Alternatively, the filler material 1792 may be injected in the interior cavity 1782 from the first weight port 1722 while the second weight port 1724 functions as an exit port for the displaced air inside the interior cavity 1782. The apparatus, methods, and articles of manufacture described herein are not limited in this regard.

For example, at least 50% of the interior cavity 1782 may be filled with the filler material 1792 to absorb shock, isolate vibration, dampen noise, and/or provide structural support when the golf club head 1700 strikes a golf ball via the face portion 1755. With the support of the back wall portion 1762 and filling at least a portion of the interior cavity 1782 with the filler material 1792, the face portion 1755 may be relatively thin without degrading the structural integrity, sound, and/or feel of the golf club head 1700. In one example, the face portion 1755 may have a thickness of less than or equal to 0.075 inch (1.905 millimeters). In another example, the face portion 1755 may have a thickness of less than or equal to 0.060 inch (1.524 millimeters). In yet another example, the face portion 1755 may have a thickness of less than or equal to 0.050 inch (1.270 millimeters). Further, the face portion 1755 may have a thickness of less than or equal to 0.030 inch (0.762 millimeters). The apparatus, methods, and articles of manufacture described herein are not limited in this regard.

In one example, the face portion 1755 may be in one-piece with the body portion 1710 or be an integral part of the body portion 1710 (not shown). The body portion 1710 may include an interior cavity near the face portion 1755 that may be similar in many respects to the interior cavity 1782. However, unlike the interior cavity 1782 which may be partially defined by the face insert 1756, an interior cavity of the body portion 1710 having a one-piece face portion 1755 may be an integral part of the body portion 1710. The interior cavity may be partially or fully filled with a filler material 1792 via the first and second weight ports 1722 and/or 1724 as described in detail herein. The apparatus, methods, and articles of manufacture described herein are not limited in this regard.

In the example of FIGS. 23-31, a golf club head 2300 may include a body portion 2310. The body portion 2310 may include a toe portion 2330, a heel portion 2340, a front portion 2350, a rear portion 2360, a top portion 2370, and a sole portion 2380. The body portion 2310 may be manufactured via various manufacturing methods and/or processes (e.g., a casting process, a forging process, a milling process, a cutting process, a grinding process, a welding process, a combination thereof, etc.). The body portion 2310 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 2310 may be partially or entirely made of non-metal material (e.g., composite, plastic, etc.). The golf club head 2300 may be a putter-type golf club head (e.g., a blade-type putter, a mid-mallet-type putter, a mallet-type putter, etc.). Based on the type of putter as mentioned above, the body portion 2310 may be at least 200 grams. For example, the body portion 2310 may be in a range between 300 to 600 grams. Although FIGS. 23-31 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 2310 may include a hosel portion 2345 configured to receive a shaft (not shown) with a grip (not shown). The golf club head 2300 and the grip may be located on opposite ends of the shaft to form a golf club. Alternatively, the body portion 2310 may include a bore (not shown) for receiving the shaft (not shown). The front and rear portions 2350 and 2360, respectively, may be on opposite ends of the body portion 2310. The front portion 2350 may include a face portion 2355 (e.g., a strike face). The face portion 2355 may be used to impact a golf ball. The face portion 2355 may be associated with a loft plane that defines the loft angle of the golf club head 2300. The apparatus, methods, and articles of manufacture described herein are not limited in this regard.

Figure 23:
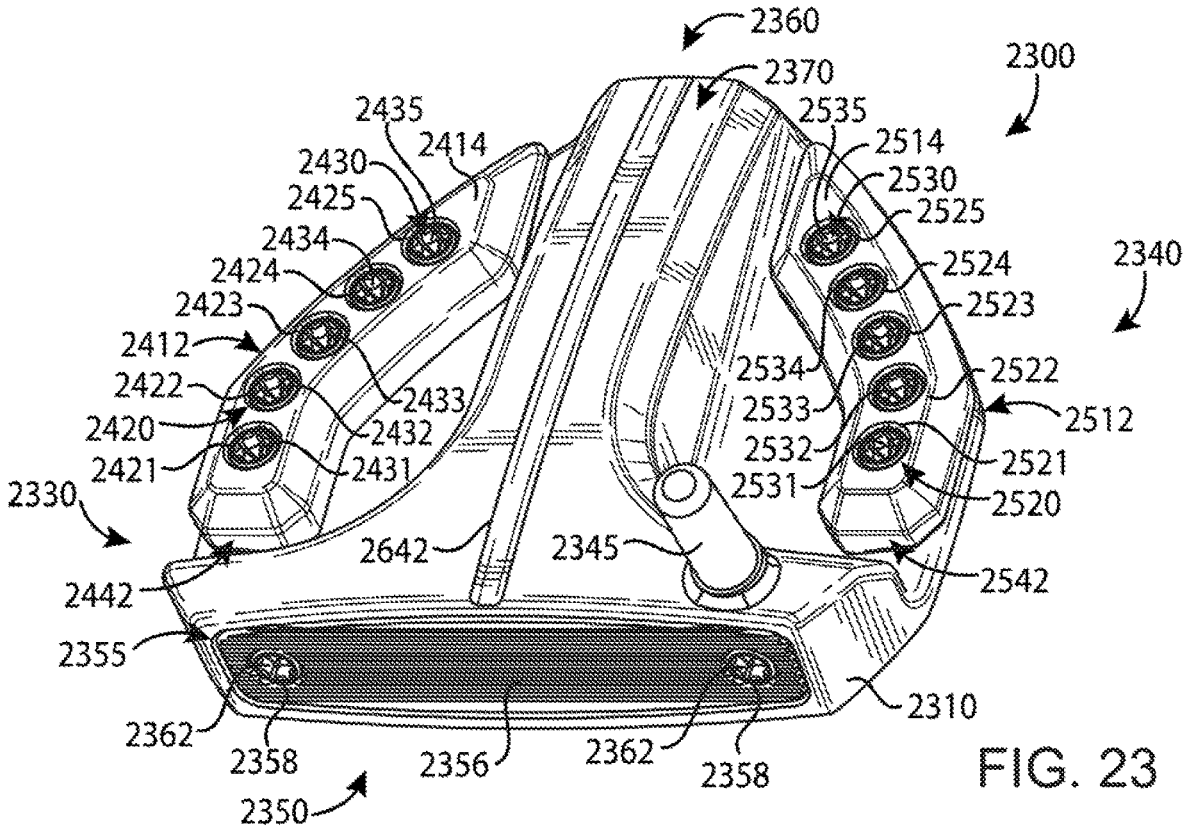
FIG. 23 depicts a front and top perspective view of a golf club head according to yet another example of the apparatus, methods, and articles of manufacture described herein.
Figure 24:
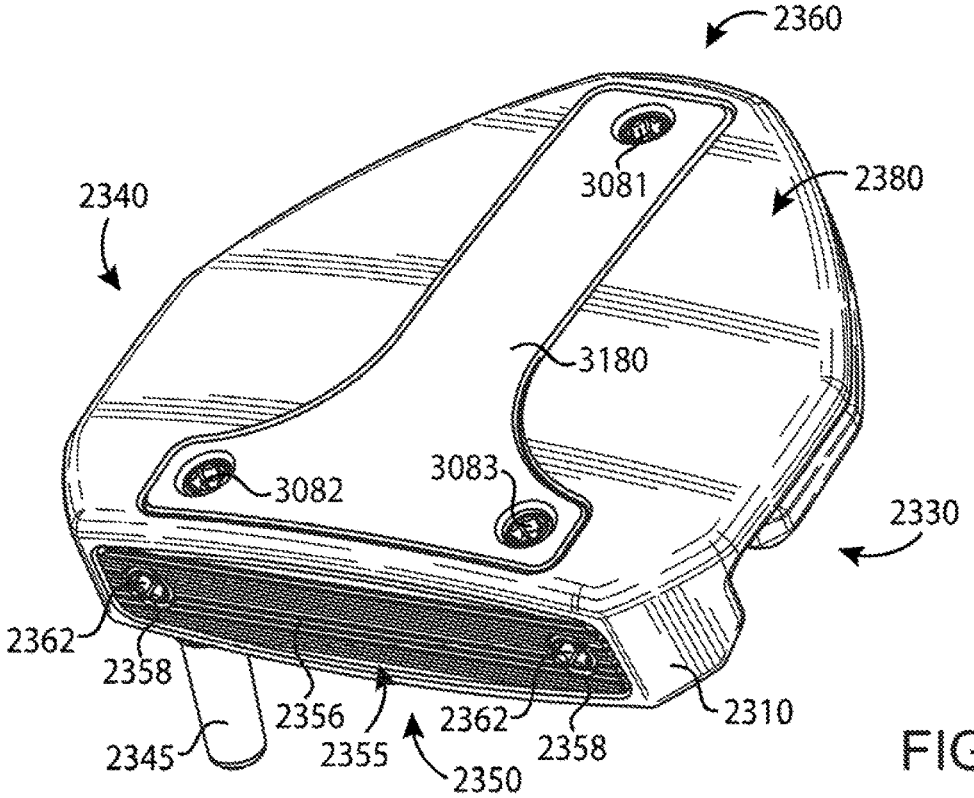
FIG. 24 depicts a front and bottom perspective view of the golf club head of FIG. 23.
Figure 25:
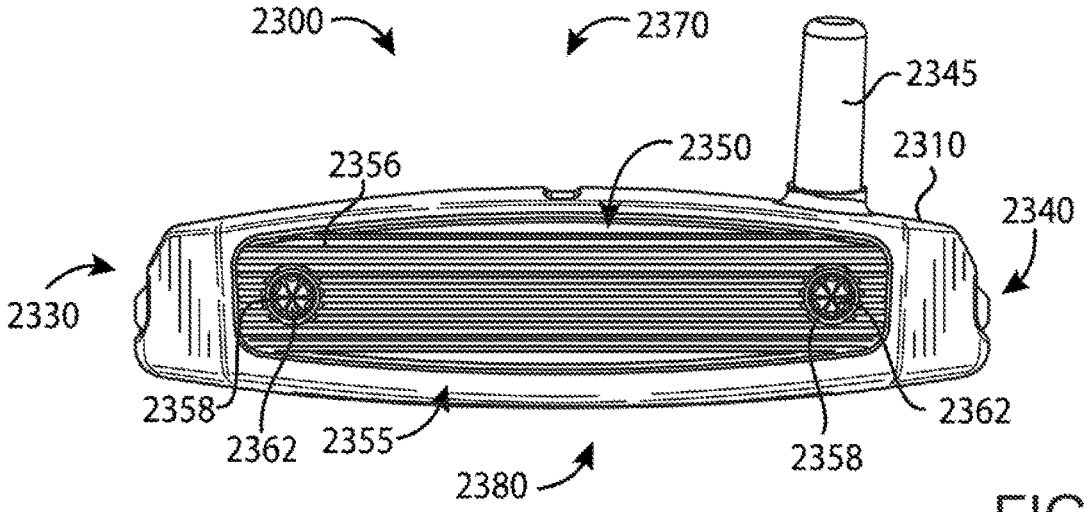
FIG. 25 depicts a front view of the golf club head of FIG. 23.
Figure 26:
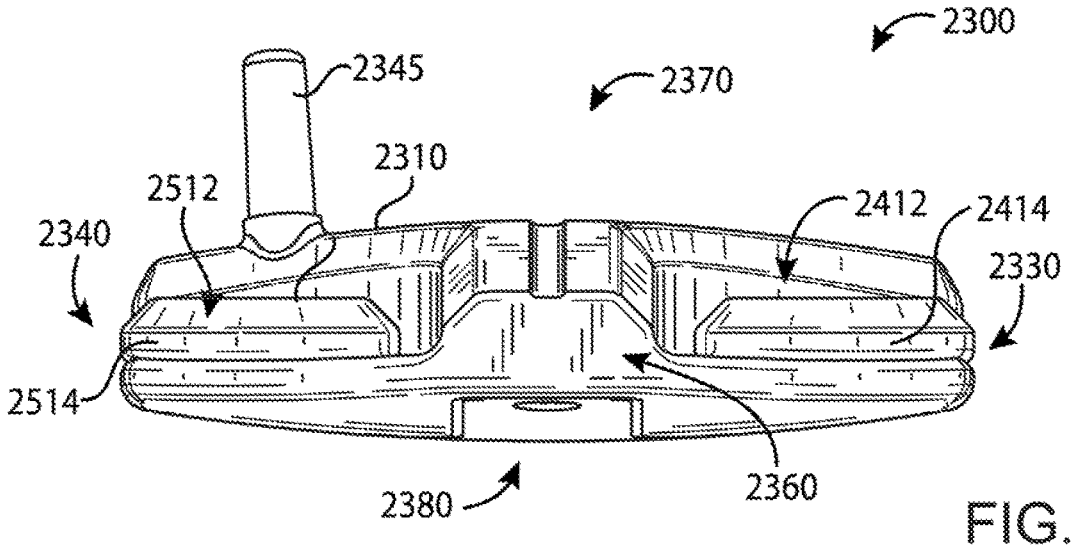
FIG. 26 depicts a rear view of the golf club head of FIG. 23.
Figure 27:
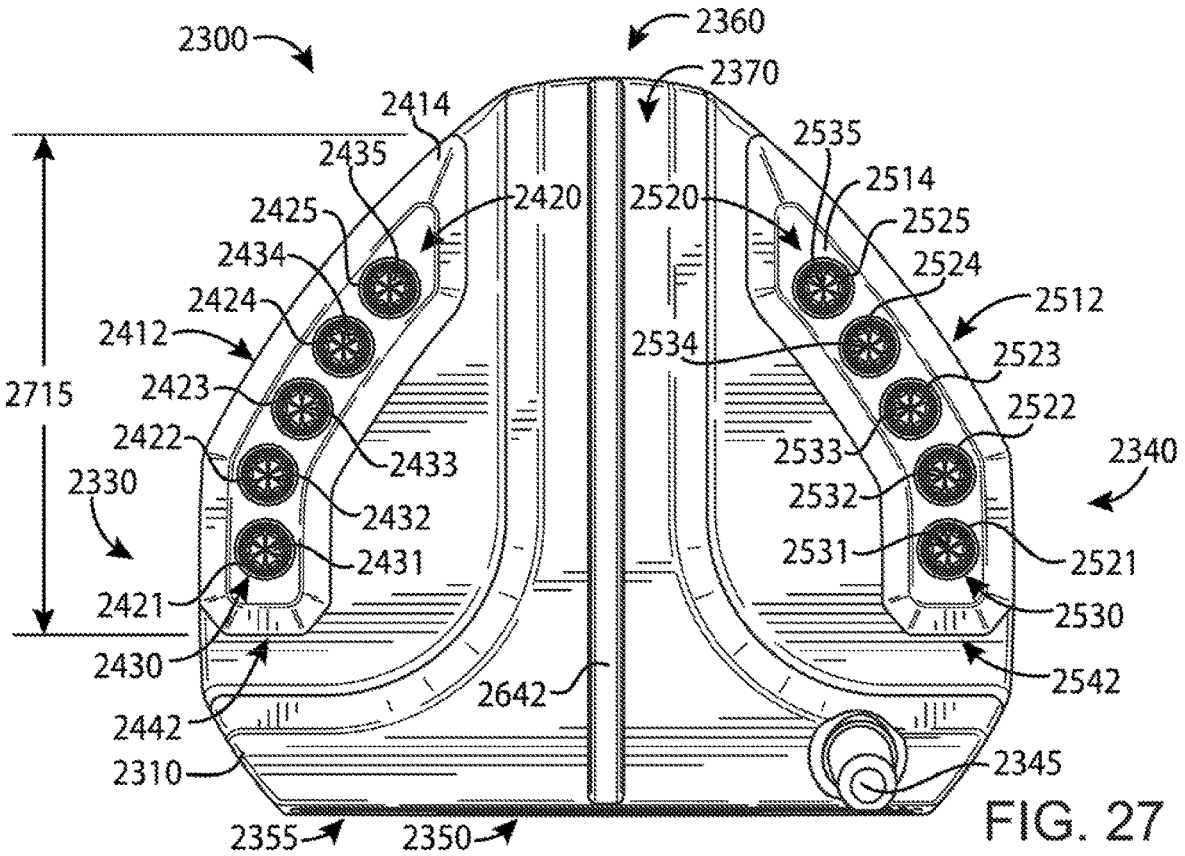
FIG. 27 depicts a top view of the golf club head of FIG. 23.

As illustrated in FIGS. 23 and 27, for example, the body portion 2310 may include two or more weight regions, generally shown as a first weight region 2412 and a second weight region 2512. The first weight region 2412 may include a first weight platform portion 2414 having a first set of weight ports 2420 (e.g., shown as weight ports 2421, 2422, 2423, 2424, and 2425). Each weight port of the first set of weight ports 2420 is configured to receive a weight portion of a first set of weight portions 2430 (e.g. shown as weight portions 2431, 2432, 2433, 2434 and 2435). The second weight region 2512 may include a second weight platform portion 2514 having a second set of weight ports 2520 (e.g., shown as weight ports 2521, 2522, 2523, 2524, and 2525). Each weight port of the second set of weight ports 2520 is configured to receive a weight portion of a second set of weight portions 2530 (e.g. shown as weight portions 2531, 2532, 2533, 2534 and 2535). Each weight portion of the first set of weight portions 2430 may be interchangeable with each weight portion of the second set of weight portions 2530. Accordingly, each weight port of the first set of weight ports 2420 and the second set of weight ports 2520 may be configured to interchangeably receive any of the weight portions of the first set of weight portions 2430 or the second set of weight portions 2530. The apparatus, methods, and articles of manufacture described herein are not limited in this regard.

Figure 28:
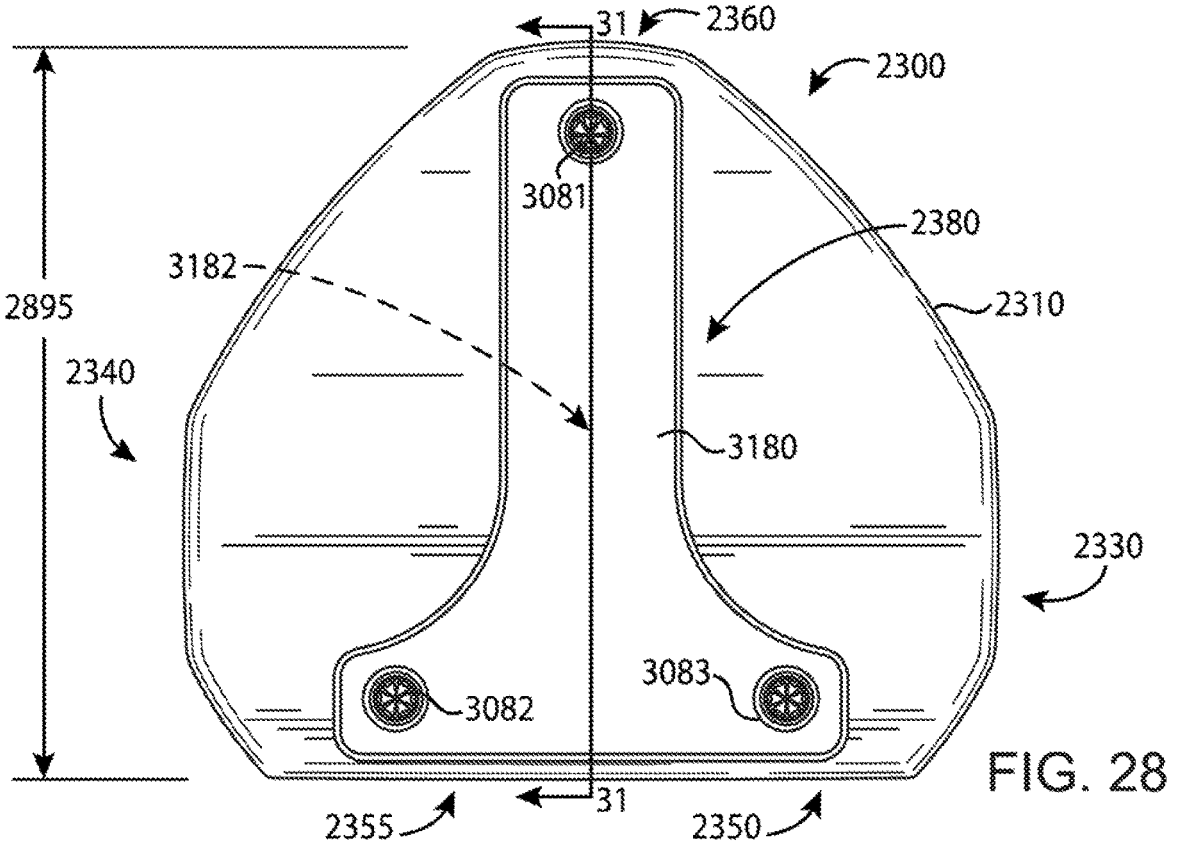
FIG. 28 depicts a bottom view of the golf club head of FIG. 23.
Figure 29:
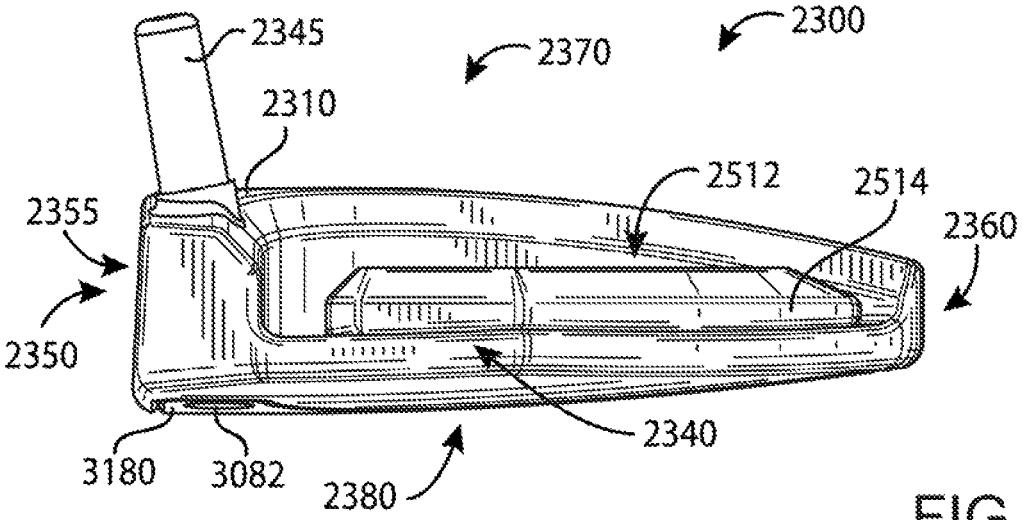
FIG. 29 depicts a left view of the golf club head of FIG. 23.
Figure 30:
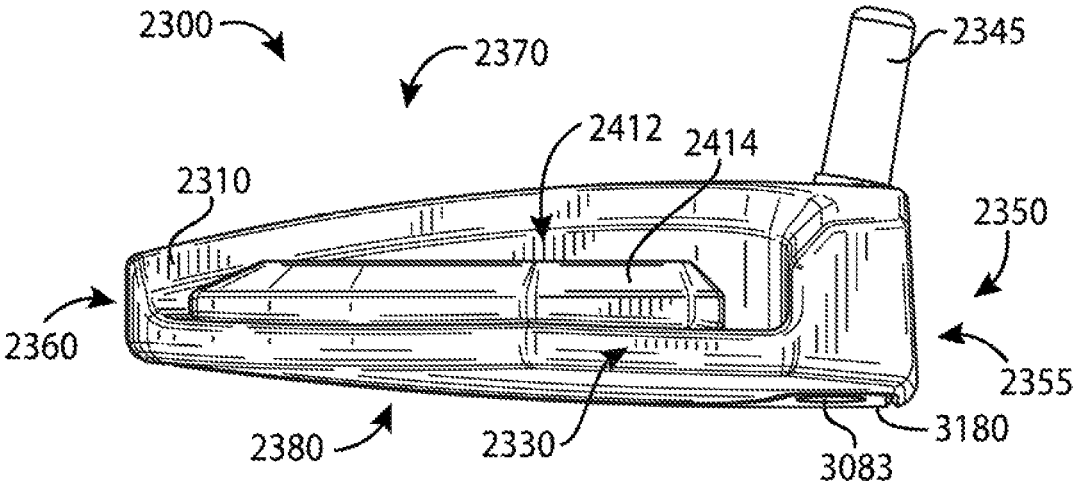
FIG. 30 depicts a right view of the golf club head of FIG. 23.

The first weight platform portion 2414 and the second weight platform portion 2514 may have a weight platform portion length (L") 2715 that may be greater than about 40% of a body portion length (LB) 2895 (FIG. 28). In one example, the weight platform portion length 2715 may be greater than 50% of the body portion length 2895. In one example, the weight platform portion length 2715 may be greater than 60% of the body portion length 2895. In one example, the weight platform portion length 2715 may be greater than 70% of the body portion length 2895. Accordingly, the mass of each of the first and second weight platform portions 2414 and 2514 may be distributed along a substantial portion of the body portion length 2895. The apparatus, methods, and articles of manufacture described herein are not limited in this regard.

The masses of the first and second weight platform portions 2414 and 2514 may be moved laterally outward on the body portion 2310. The mass of each of the first and second weight platform portions 2414 and 2514 may be between 5% and 30% of the mass of the body portion 2310 including the mass of the first weight platform portion 2414 and the second weight platform portion 2514. In one example, the mass of each of the first and second weight platform portions 2414 and 2514 may be between about 3% and about 13% of the mass of the body portion 2310 if the first and second weight platform portions 2414 and 2514 are made from relatively lighter metals such as metals including titanium or titanium alloys. In another example, the mass of each of the first and second weight platform portions 2414 and 2514 may be between about 8% and about 21% of the mass of the body portion 2310 if the first and second weight platform portions 2414 and 2514 are made from metals including steel. In yet another example, the mass of each of the first and second weight platform portions 2414 and 2514 may be between about 10% and about 30% of the mass of the body portion 2310 if the first and second weight platform portions 2414 and 2514 are made from relatively heavier metals such as metals including magnesium or magnesium alloys. Accordingly, between about 3% and about 30% of the mass of the body portion 2310 may be redistributed to the toe portion 2330 and the heel portion 2340 by the first and second weight platform portions 2414 and 2514 from other parts of the body portion 2310. Further, the first weight platform portion 2414 may be located at or proximate to the periphery of the toe portion 2330 and the second weight platform portion 2514 may be located at or proximate to the periphery of the heel portion 2340. The apparatus, methods, and articles of manufacture described herein are not limited in this regard.

Each weight port of the first set of weight ports 2420 may have a first port diameter ($PD_1$). In particular, a uniform distance of less than the first port diameter may separate any two adjacent weight ports of the first set of weight ports 2420 (e.g., (i) weight ports 2421 and 2422, (ii) weight ports 2422 and 2423, (iii) weight ports 2423 and 2424, or (iv) weight ports 2424 and 2425). In one example, the first port diameter may be about 0.25 inch (6.35 millimeters) and any two adjacent weight ports of the first set of weight ports 2420 may be separated by 0.1 inch (2.54 millimeters). Each weight port of the second set of weight ports 2520 may have a second port diameter ($PD_2$). A uniform distance of less than the second port diameter may separate any two adjacent weight ports of the second set of weight ports 2520 (e.g., (i) weight ports 2521 and 2522, (ii) weight ports 2522 and 2523, (iii) weight ports 2523 and 2524, or (iv) weight ports 2524 and 2525). For example, the second port diameter may be about 0.25 inch (6.35 millimeters) and any two adjacent weight ports of the second set of weight ports 2520 may be separated by 0.1 inch (2.54 millimeters). The first and second port diameters may be equal to each other (i.e., $PD_1=PD_2$). Alternatively, the first and second port diameters may be different. The apparatus, methods, and articles of manufacture described herein are not limited in this regard.

The first weight platform portion 1414, the first set of weight ports 2420 (weight ports 2421, 2422, 2423, 2424, and 2425), and/or the first set of weight portions 2430 (weight portions 2431, 2432, 2433, 2434, and 2435) may form a first visual guide portion 2442. The second weight platform portion 2514, the second set of weight ports 2520 (weight ports 2521, 2522, 2523, 2524, and 2525), and/or the second set of weight portions 2530 (weight portions 2531, 2532, 2533, 2534, and 2535) may form a second visual guide portion 2542. The first weight region 2412 may be located at or proximate to a periphery of the toe portion 2330 of the golf club head 2300. Accordingly, the first visual guide portion 2442 may be located at or proximate to the periphery of the toe portion 2330. The second weight region 2512 may be located at or proximate to the periphery of the heel portion 2340 of the golf club head 2300. Accordingly, the second visual guide portion 2542 may be located at or proximate to the periphery of the heel portion 2340. The first weight platform portion 2414 and/or any of the weight portions of the first set of weight portions 2430 may have distinct colors, markings and/or other visual features so as to be visually distinguished from the surrounding portions of the body portion 2310. Similarly, the second weight platform portion 2514 and/or any of the weight portions of the second set of weight portions 2530 may have distinct colors, markings and/or other visual features so as to be visually distinguished from the surrounding portions of the body portion 2310. The apparatus, methods, and articles of manufacture described herein are not limited in this regard.

The golf club head 2300 may also include a third visual guide portion 2642, which may be substantially equidistant from the first and second visual guide portions 2442 and 2542. For example, the third visual guide portion 2642 may extend between the front and rear portions 2350 and 2360 located at or proximate to a center of the body portion 2310. The third visual guide portion 2642 may be the same as or different from the first and/or second visual guide portions 2442 and 2542, respectively. In one example, the third visual guide portion 2642 may be a recessed line portion having a certain color. In another example, the third visual guide portion 2642 may include a plurality of weight ports (not shown) with a plurality of weight portions (not shown) received therein. Alternatively, the third visual guide portion 2642 may be defined by a raised portion of the top portion 2370. The third visual guide portion 2642 may be similar in many respects to any of the visual guide portions described herein. Therefore, a detailed description of the third visual guide portion 2642 is not provided. The apparatus, methods, and articles of manufacture described herein are not limited in this regard.

The first and second sets of weight portions 2430 and 2530, respectively, may have similar or different physical properties (e.g., density, shape, mass, volume, size, color, etc.). The first and second sets of weight portions 2430 and 2530, respectively, may include threads to secure in the weight ports of the first and second sets of weight ports 2420 and 2520, respectively. The physical properties of the weight portions of the first and second sets of weight portions 2430 and 2530, respectively, may be similar in many respects to any of the weight portions described herein. Therefore, a detailed description of the physical properties of the weight portions of the first and second sets of weight portions 2430 and 2530, respectively, is not provided. The apparatus, methods, and articles of manufacture described herein are not limited in this regard.

The first weight platform portion 2414 may be attached to the body portion 2310 with any one or more weight portions of the first set of weight portions 2430 or the second set of weight portions 2530. The body portion 2310 may include a plurality of toe side threaded bores (not shown) on the top portion 2370 at or proximate to the toe portion 2330. When the first weight platform portion 2414 is placed on the top portion 2370 at or proximate to the periphery of the toe portion 2330 as shown in FIGS. 23 and 27, for example, the toe side threaded bores may generally align with the weight ports of the first set of weight ports 2420. When a weight portion of the first set of weight portions 2430 or the second set of weight portions 2530 is inserted in a weight port of the first set of weight ports 2420, the weight portion extends through a corresponding one of the toe side threaded bores of the body portion 2310 such that the threads on the weight portion engage the corresponding threads in the toe side threaded bore. The weight portion can then be screwed into the corresponding toe side threaded bore to fasten the first weight platform portion 2414 on the body portion 2310. The apparatus, methods, and articles of manufacture described herein are not limited in this regard.

The second weight platform portion 2514 may be attached to the body portion 2310 with any one or more weight portions of the first set of weight portions 2430 or the second set of weight portions 2530. The body portion 2310 may include a plurality of heel side threaded bores (not shown) on the top portion 2370 at or proximate to the heel portion 2340. When the second weight platform portion 2514 is placed on the top portion 2370 at or proximate to the periphery of the heel portion 2340 as shown in FIGS. 23 and 27, for example, the heel side threaded bores generally align with the weight ports of the second set of weight ports 2520. When a weight portion of the first set of weight portions 2430 or the second set of weight portions 2530 is inserted in a weight port of the second set of weight ports 2520, the weight portion extends through a corresponding one of the heel side threaded bores of the body portion 2310 such that the threads on the weight portion engage the corresponding threads in the heel side threaded bore. The weight portion can then be screwed into the corresponding heel side threaded bore to fasten the second weight platform portion 2514 on the body portion 2310. The apparatus, methods, and articles of manufacture described herein are not limited in this regard.

Each of the weight portions of the first and second sets of weight portions 2430 and 2530, respectively, may have sufficient length to extend through a weight port and into a corresponding threaded bore of the body portion 2310 as described herein to fasten the first weight platform portion 2414 and the second weight platform portion 2514 to the body portion 2310. One or more weight portions of the first set of weight portions 2430 and/or one or more weight portions of the second set of weight portions 2530 may function both as weights for configuring a weight distribution of the golf club head 2300 and as fasteners for fastening the first weight platform portion 2414 and/or the second weight platform portion 2514 on the body portion 2310. Alternately, the first weight platform portion 2414 and/or the second weight platform portion 2514 may be fastened on the body portion 2310 by using other types of fastening mechanisms such that one or more weight portions of the first set of weight portions 2430 and/or one or more weight portions of the second set of weight portions 2530 may only function as weight portions. The apparatus, methods, and articles of manufacture described herein are not limited in this regard.

Each of the first and second weight platform portions 2414 and 2514, respectively, may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The first and second weight platform portions 2414 and 2514, respectively, may have a similar mass or different masses to optimally affect the weight distribution, center or gravity location, and/or moment of inertia of the golf club head 2300. Each of the first and second weight platform portions 2414 and 2514 may function as an added weight for the body portion 2310 and as a platform for receiving additional weights for the body portion 2310 in the form of the first and second sets of weight portions 2430 and 2530. Thus, the physical properties and the materials of construction of the first and second weight platform portions 2414 and/or 2514 may be determined to optimally affect the weight, weight distribution, center of gravity, moment of inertia characteristics, structural integrity and/or or other static and/or dynamic characteristics of the golf club head 2300. The apparatus, methods, and articles of manufacture described herein are not limited in this regard.

In one example, the face portion 2355 may be in one-piece with the body portion 2310 or be an integral part of the body portion 2310 (not shown). The face portion 2355 may include a separate piece or an insert coupled to the body portion 2310. The face portion 2355 may include a face insert 2356, which may be attached to the front portion 2350 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 23-25, the face insert 2356 may include two fastener holes 2358 proximate to the toe portion and heel portion of the face insert 2356. Each of the fastener holes 2358 may be configured to receive a fastener 2362 for attachment of the face insert 2356 to the body portion 2310. The body portion 2310 may include two fastener ports (not shown) configured to receive the fasteners 2362. The fasteners 2362 may be similar or substantially similar to the weight portions of the first set of weight portions 2430 and/or the weight portions of the second set of weight portions 2530. Accordingly, the fasteners 2362 may function both as weights for configuring a weight distribution of the golf club head 2300 and as fasteners for fastening the face insert 2356 to the face portion 2355. Each fastener port may have internal threads that are configured to engage external threads on the fasteners 2362. The fastener ports of the body portion 2310 may be similar in many respects to the fastener ports 1768 of the golf club head 1700 described herein. The apparatus, methods, and articles of manufacture described herein are not limited in this regard.

The face portion 2355 may include a peripheral recessed portion 3172 (shown in FIG. 31) configured to receive the face insert 2356. As shown by example in FIG. 31, the depth of the peripheral recessed portion 3172 may be similar to the thickness of the face insert 2356 such that when the face insert 2356 is fastened to the body portion 2310, the face insert 2356 is positioned flush or substantially flush with the face portion 2355. Alternatively, the face insert 2356 may project from the face portion 2355. The apparatus, methods, and articles of manufacture described herein are not limited in this regard.

As described, the fasteners 2362 may be similar or substantially similar to the weight portions of the first set of weight portions 2430 and/or the weight portions of the second set of weight portions 2530 so that the fasteners 2362 may function to configure the weight distribution of the golf club head 2300. Accordingly, the fasteners 2362 may have similar or different weights to balance and/or provide heel or toe weight bias for the golf club 2300. For example, the weight of the body portion 2310 may be increased or decreased by similarly increasing or decreasing, respectively, the weights of the fasteners 2362. In one example, the golf club head 2300 may be provided with a toe-biased weight configuration by having the fastener 2362 that is closer to the toe portion 2330 be heavier than the fastener 2362 that is closer to the heel portion 2340. Conversely, the golf club head 2300 may be provided with a heel-biased weight configuration by having the fastener 2362 that is closer to the heel portion 2340 be heavier than the fastener 2362 that is closer to the toe portion 2330. The apparatus, methods, and articles of manufacture described herein are not limited in this regard.

To attach the face insert 2356 to the body portion 2310, the face insert 2356 may be inserted in the peripheral recessed portion 3172, thereby generally aligning the fastener holes 2358 of the face insert 2356 and the fastener ports (not shown) of the body portion 2310. The fasteners 2362 can be inserted through the fastener holes 2358 and screwed into the fastener ports of the body portion 2310 to securely attach the face insert 2356 to the body portion 2310. The face insert 2356 may be constructed from any material such as metal, metal alloys, plastic, wood, composite materials or a combination thereof to provide a certain ball striking characteristic to the golf club head 2300. The material from which the face insert 2356 is manufactured may affect ball speed and spin characteristics. Accordingly, the face insert 2356 may be selected to provide a certain ball speed and spin characteristics for an individual. Thus, the face insert 2356 may be interchangeable with other face inserts having different ball speed and spin characteristics. The face insert 2356 may be coupled to the body portion 2310 by other methods or devices, such as by bonding, welding, adhesive and/or other types of fastening devices and/or methods. The apparatus, methods, and articles of manufacture described herein are not limited in this regard.

The body portion 2310 may include an interior cavity 3182 (shown in FIG. 31) extending between the front portion 2350 and the rear portion 2360 and between the toe portion 2330 and the heel portion 2340. The interior cavity 3182 may be open or accessible at the face portion 2355 and/or at the sole portion 2380. Accordingly, the interior cavity 3182 may have a first opening 3176 at the face portion 2355 and/or a second opening 3178 at the sole portion 2380. The interior cavity 3182 allows the mass of the body portion 2310 to be removed at or around the center portion of the body portion 2310 so that removed mass may be redistributed to the toe portion 2330 and the heel portion 2340 using the first weight platform portion 2414 and the second weight platform portion 2514 without affecting or substantially affecting the overall mass of the golf club head 2300. The apparatus, methods, and articles of manufacture described herein are not limited in this regard.

Figure 31:
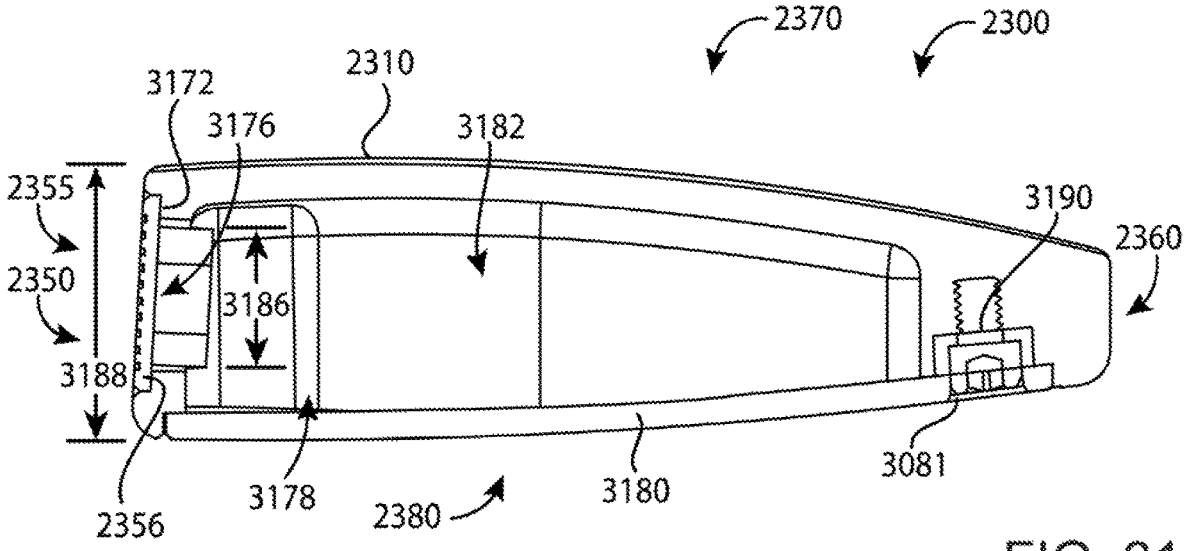
FIG. 31 depicts a cross-sectional view of the golf club head of FIG. 23 taken at lines 31-31 of FIG. 31.
Figure 32:
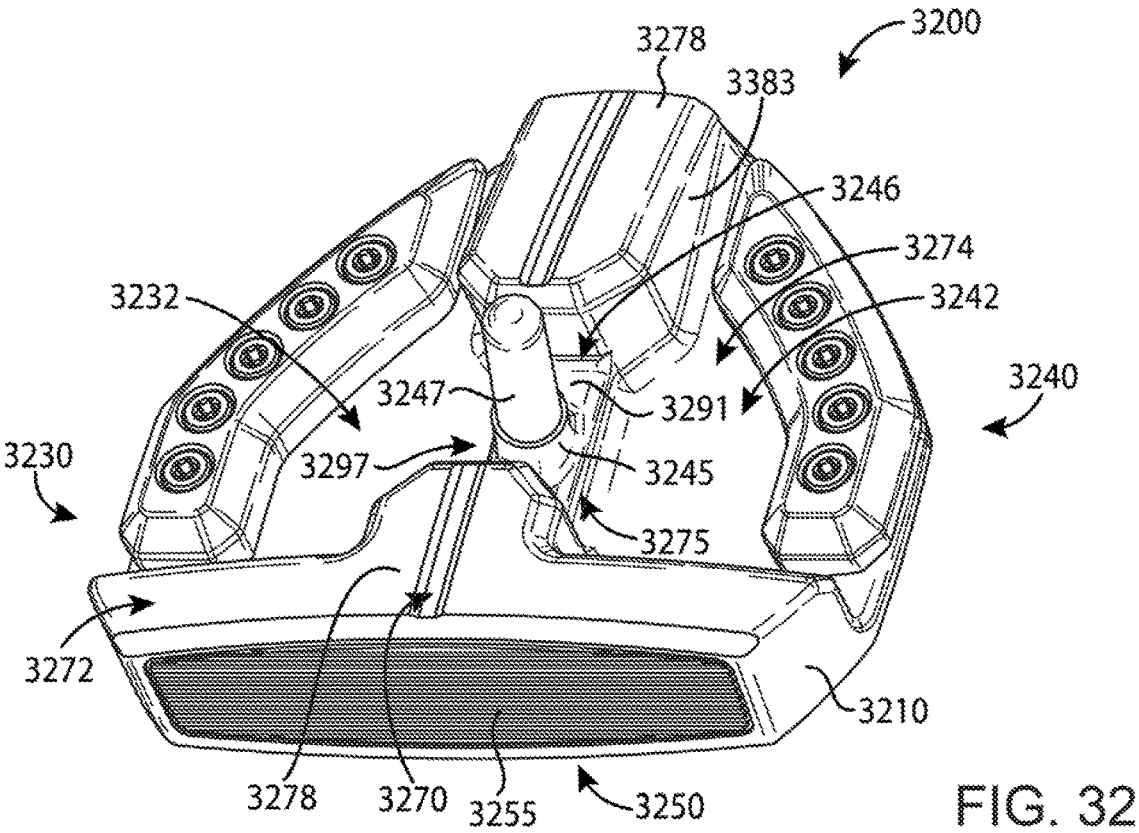
FIG. 32 depicts a front and top perspective view of a golf club head according to yet another example of the apparatus, methods, and articles of manufacture described herein.
Figure 33:
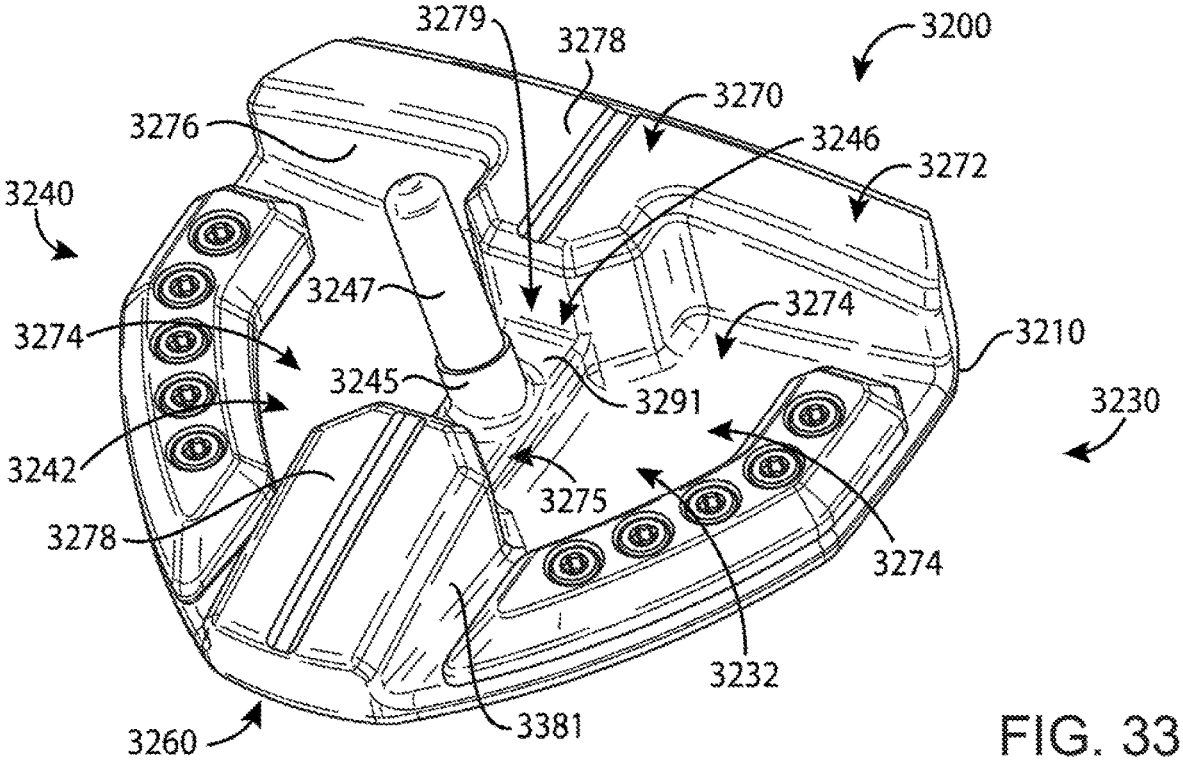
FIG. 33 depicts a rear and top perspective view of the golf club head of FIG. 32.
Figure 34:
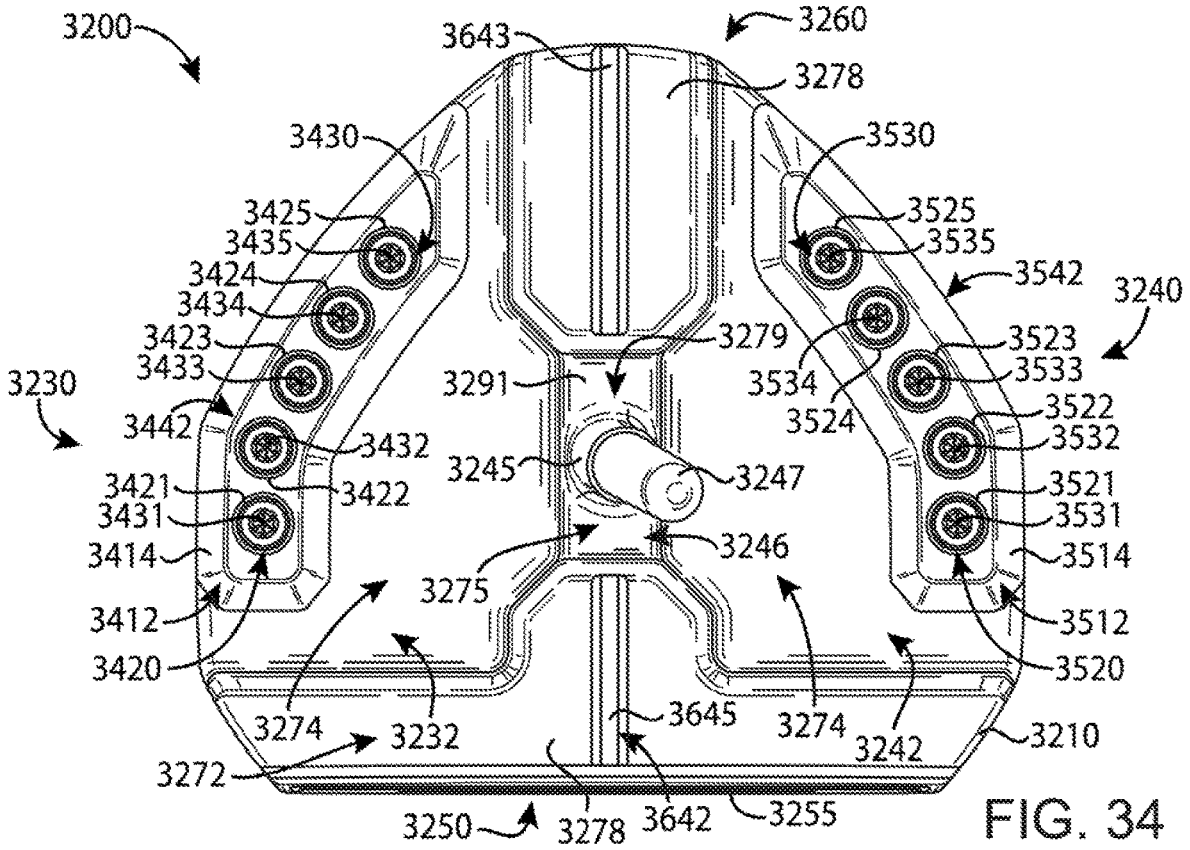
FIG. 34 depicts a top view of the golf club head of FIG. 32.
Figure 35:
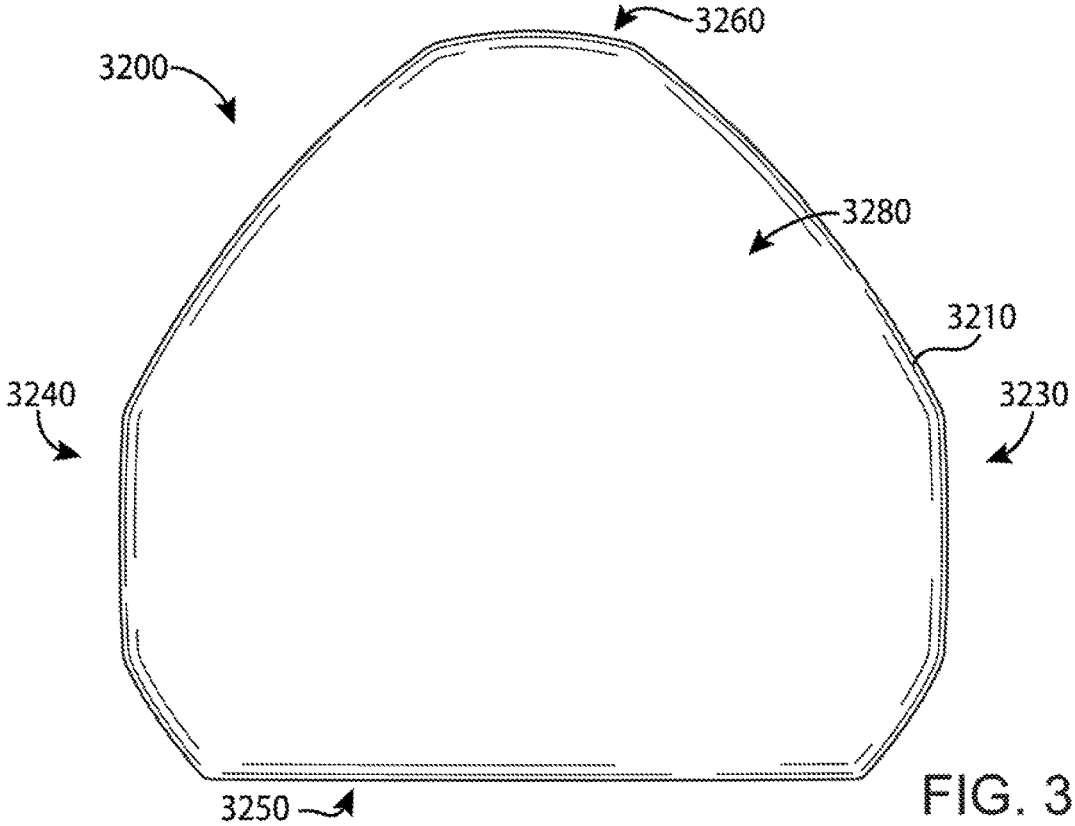
FIG. 35 depicts a bottom view of the golf club head of FIG. 32.
Figure 36:
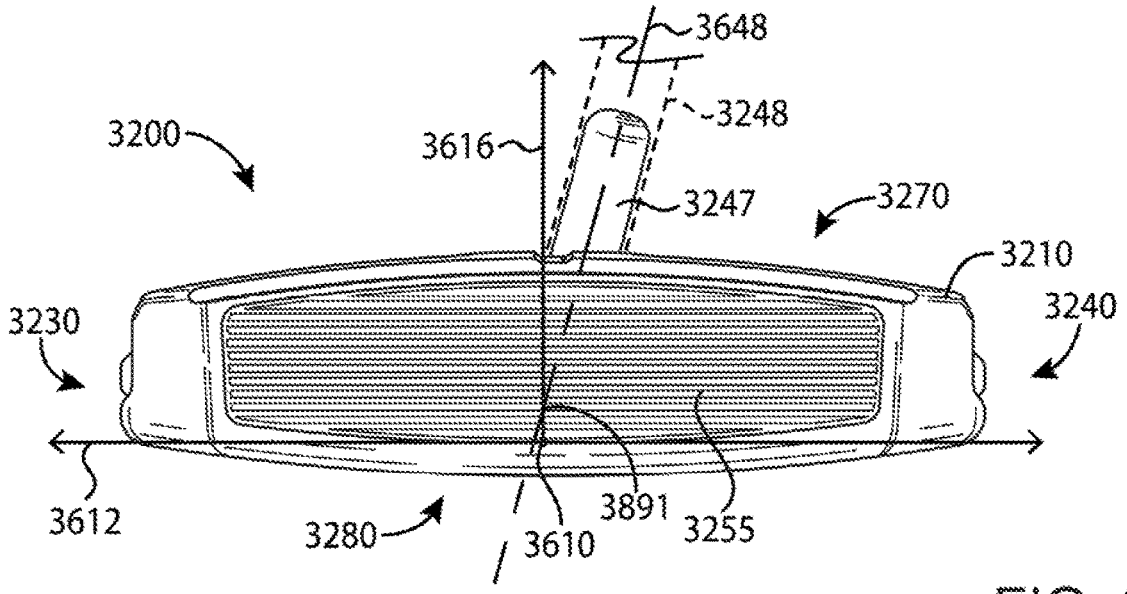
FIG. 36 depicts a front view of the golf club head of FIG. 32.
Figure 37:
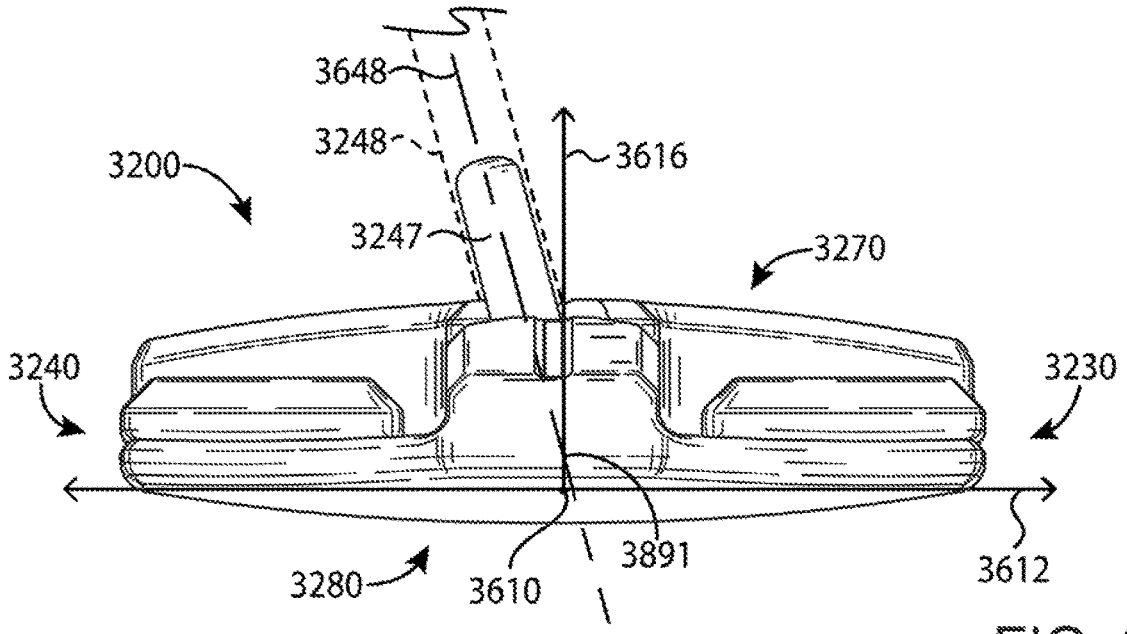
FIG. 37 depicts a rear view of the golf club head of FIG. 32.
Figure 38:
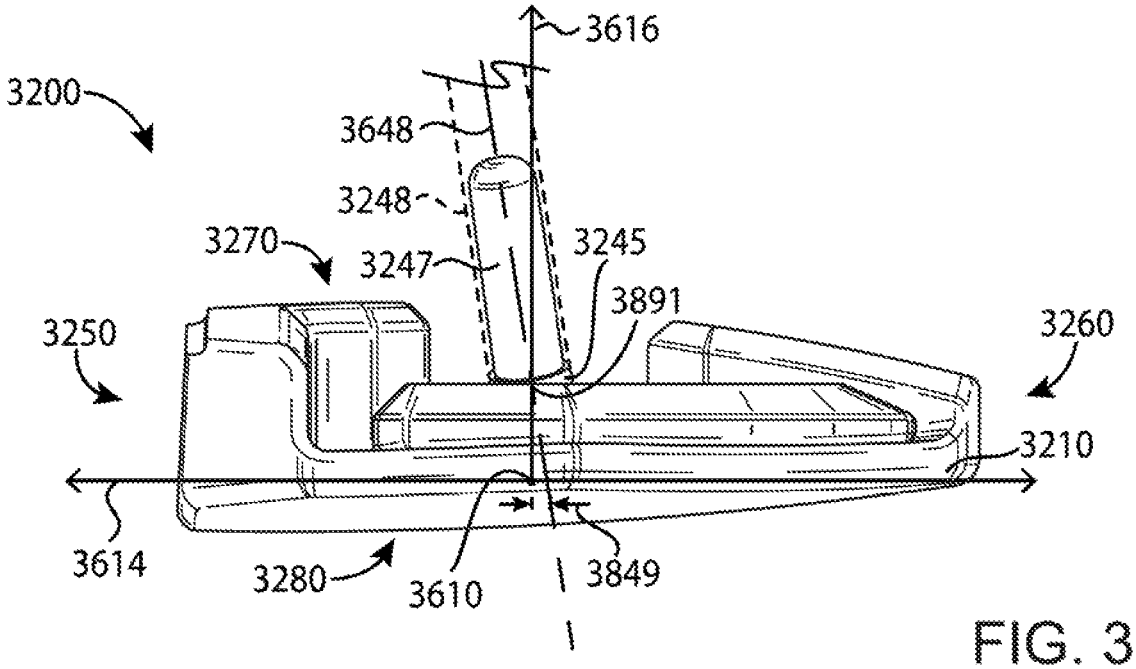
FIG. 38 depicts a left view of the golf club head of FIG. 32.
Figure 39:
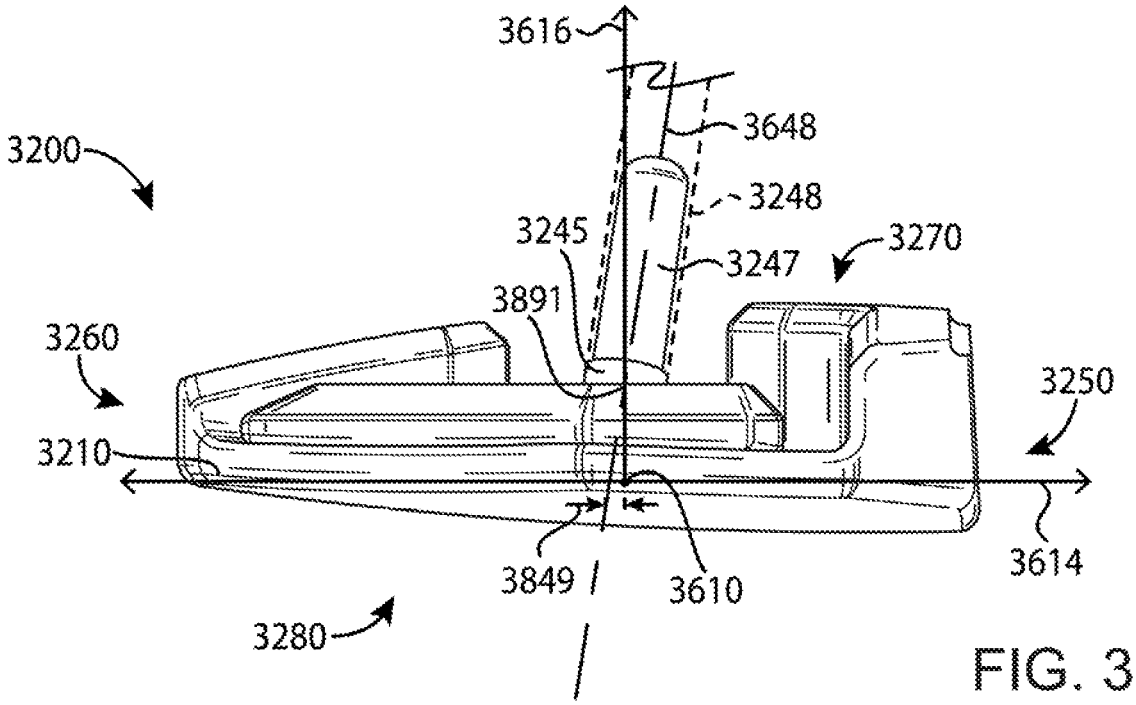
FIG. 39 depicts a right view of the golf club head of FIG. 32.

In one example as shown in FIGS. 28 and 31, the interior cavity 3182 may be covered at the face portion 2355 by the face insert 2356 and at the sole portion 2380 by a cover or sole plate 3180. In one example, the sole plate 3180 may have a mass between 7% and 17% of the mass of the golf club head 2300. In one example, the sole plate 3180 may have a mass between 10% and 15% of the mass of the golf club head 2300. As described herein, the interior cavity 3182 allows the mass of the body portion 2310 to be removed at or around the center portion of the body portion 2310. The removed mass can be also redistributed to the sole portion 2380 using the sole plate 3180 to lower the center of gravity of the golf club head 2300 without affecting or substantially affecting the overall mass of the golf club head 2300. The apparatus, methods, and articles of manufacture described herein are not limited in this regard.

The sole plate 3180 may be attached to the sole portion 2380 with one or more fasteners. In the example of FIGS. 24 and 28-31, the sole plate 3180 may be attached to the sole portion 2380 with fasteners 3081, 3082, and 3083 to cover the second opening 3178 of the interior cavity 3182 at the sole portion 2380. Each of the fasteners 3081, 3082, and 3083 may have a threaded portion that is configured to engage a correspondingly threaded bore 3190 (shown in FIG. 31) in the body portion 2310. The fasteners 3081, 3082, and/or 3083 may be similar or substantially similar to the weight portions of the first set of weight portions 2430 and/or the weight portions of the second set of weight portions 2530. Accordingly, the fasteners 3081, 3082, and/or 3083 may function both as weights for configuring a weight distribution of the golf club head 2300 and as fasteners for fastening the sole plate 3180 to the sole portion 2380. The fasteners 3081, 3082, and/or 3083 may also lower the center of gravity of the golf club head 2300 by adding more mass to the sole portion 2380 without affecting or substantially affecting the overall mass of the golf club head 2300 as described herein with respect to the sole plate 3180. The apparatus, methods, and articles of manufacture described herein are not limited in this regard.

The sole plate 3180 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The physical properties and the materials of construction of the sole plate 3180 may be determined to optimally affect the weight, weight distribution, center of gravity, moment of inertia characteristics, structural integrity and/or or other static and/or dynamic characteristics of the golf club head 2300. The apparatus, methods, and articles of manufacture described herein are not limited in this regard.

The interior cavity 3182 may extend from near the toe portion 2330 to near the heel portion 2340 and from near the top portion 2370 to near the sole portion 2380. Alternatively, the interior cavity 3182 may extend between the front portion 2350 and the rear portion 2360 and include a portion of the body portion 2310 between the toe portion 2330 and near the heel portion 2340 and between the top portion 2370 and near the sole portion 2380. In one example, a portion of the interior cavity 3182 may be located proximate to the regions of the face portion 2355 that generally strike a golf ball. In one example, the interior cavity 3182 may be only at the face portion 2355 similar to the interior cavity 1782 of the golf club head 1700 described herein. The apparatus, methods, and articles of manufacture described herein are not limited in this regard.

The interior cavity 3182 proximate to the face portion 2355 may be associated with a cavity height 3186 ($H_C$), and the body portion 2310 proximate to the face portion 2355 may be associated with a body height 3188 ($H_B$). While the cavity height 3186 and the body height 3188 may vary between the toe and heel portions 2330 and 2340, the front and rear portions 2350 and 2360, and the top and sole portions 2370 and 2380, the cavity height 3186 may be at least 50% of the body height 3188 ($H_C>0.5*H_B$) proximate to the face portion 2355 or an any location of the interior cavity 3182. For example, the cavity height 3186 may vary between 70% and 85% of the body height 3188. With the cavity height 3186 of the interior cavity 3182 being greater than 50% of the body height 3188, the golf club head 2300 may produce relatively more consistent feel, sound, and/or result when the golf club head 2300 strikes a golf ball via the face portion 2355 than a golf club head with a cavity height of less than 50% of the body height. However, the cavity height 3186 may be less than 50% of the body height 3188. The apparatus, methods, and articles of manufacture described herein are not limited in this regard.

In one example, the interior cavity 3182 may be unfilled (i.e., empty space). Alternatively, the interior cavity 3182 may be partially or entirely filled with a filler material (not shown) to absorb shock, isolate vibration, and/or dampen noise when the face portion 2355 strikes a golf ball. The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 3182 may be filled with a TPE material to absorb shock, isolate vibration, and/or dampen noise when the golf club head 2300 strikes a golf ball via the face portion 2355. In one example, the mass of the filler material (e.g., TPE, TPU, etc.) may be between 3% and 13% of the mass of the golf club head 2300. In one example, the mass of the filler material may be between 6% and 10% of the mass of the golf club head 2300. The apparatus, methods, and articles of manufacture described herein are not limited in this regard.

In another example, the filler material may be a polymer material such as an ethylene copolymer material to absorb shock, isolate vibration, and/or dampen noise when the golf club head 2300 strikes a golf ball via the face portion 2355. In particular, at least 50% of the interior cavity 3182 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 3182 may be partially or fully filled with the filler material. In one example, the interior cavity 3182 may be filled with the filler material from the first opening 3176 and/or the second opening 3178 prior to attaching the face insert 2356 and/or the sole plate 3180, respectively, to the body portion 2310. In one example, the interior cavity 3182 may be filled with the filler material after the face insert 2356 and the sole plate 3180 are attached to the body portion 2310 by injecting the filler material into the interior cavity 3182 through one or more ports (not shown) on the sole plate 3180. The filler material may be injected into the interior cavity 3182 from one or more ports on the sole plate 3180 while the air inside the interior cavity 3182 that is displaced by the filler material may exit the interior cavity 3182 from one or more other ports on the sole plate 3180. The apparatus, methods, and articles of manufacture described herein are not limited in this regard.

For example, at least 50% of the interior cavity 3182 may be filled with the filler material to absorb shock, isolate vibration, dampen noise, and/or provide structural support when the golf club head 2300 strikes a golf ball via the face portion 2355. With the filler material, the face portion 2355 may be relatively thin without degrading the structural integrity, sound, and/or feel of the golf club head 2300. In one example, the face portion 2355 may have a thickness of less than or equal to 0.075 inch (1.905 millimeters). In another example, the face portion 2355 may have a thickness of less than or equal to 0.060 inch (1.524 millimeters). In yet another example, the face portion 2355 may have a thickness of less than or equal to 0.050 inch (1.270 millimeters). Further, the face portion 2355 may have a thickness of less than or equal to 0.030 inch (0.762 millimeters). The apparatus, methods, and articles of manufacture described herein are not limited in this regard.

In the example of FIGS. 32-39, a golf club head 3200 may include a body portion 3210 having a toe portion 3230, a heel portion 3240, a front portion 3250, a rear portion 3260, a top portion 3270, and a sole portion 3280. The body portion 3210 may include a hosel portion 3245 having a stem portion 3247 configured to receive a shaft 3248 with a grip (not shown). The grip may be on one end of the shaft 3248 and the golf club head 3200 on the opposite end of the shaft 3248 to form a golf club. Alternatively, the body portion 3210 may include a bore (not shown) for receiving the shaft 3248. The front and rear portions 3250 and 3260, respectively, may be on opposite ends of the body portion 3210. The front portion 3250 may include a face portion 3255 (e.g., a strike face). The face portion 3255 may be used to impact a golf ball. The face portion 3255 may be associated with a loft plane that defines the loft angle of the golf club head 3200. The body portion 3210 may be manufactured by any method and/or processes including the methods and/or processes described herein. The body portion 3210 may be partially or entirely made from any material including any of the materials described herein. The body portion 3210 may be any type of golf club head having a certain volume. Although FIGS. 32-39 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The top portion 3270 may include an upper portion 3272 and a lower portion 3274. The upper portion 3272 of the top portion 3270 may extend from the front portion 3250 toward the rear portion 3260. The upper portion 3272 may transition into the lower portion 3274 by a back wall portion 3276 and a center portion 3278. The back wall portion 3276 may be opposite the face portion 3255. The center portion 3278 may extend from the front portion 3250 to the rear portion 3260 and may be equidistant from the toe portion 3230 and the heel portion 3240. The center portion 3278 may include side walls 3381 and 3383 that extend from the back wall portion 3276 to the rear portion 3260. Accordingly, the center portion 3278 defines a toe side portion 3232 of the lower portion 3274 and a heel side portion 3242 of the lower portion 3274. The center portion 3278 may include a recess portion 3279 that extends from the upper portion 3272 to the lower portion 3274. The center portion 3278 may include an intermediate portion 3275 located in the recess portion 3279. The intermediate portion 3275 may be positioned higher than the lower portion 3274 and lower than the upper portion 3272. In other words, the intermediate portion 3275 may be positioned between the lower portion 3274 and the upper portion 3272. In one example, the intermediate portion 3275 may serve as a platform for the hosel portion 3245. The apparatus, methods, and articles of manufacture described herein are not limited in this regard.

In one example, as shown in FIGS. 32-39, the hosel portion 3245 may be located at or proximate a central area 3246 of the body portion 3210 such that a center axis 3648 of the shaft 3248 may pass through or pass near a center of gravity (CG) 3610 of the golf club head 3200. The stem portion 3247 and the shaft 3248 may be concentric, and therefore, the center axis 3648 may correspond to a centerline longitudinal axis that is common to both the stem portion 3247 and the shaft 3248. The CG 3610 of the golf club head 3200 may be the origin of CG coordinate axes with a CG x-axis 3612, a CG y-axis 3614, and a CG z-axis 3616. In one example, the CG x-axis 3612 may correspond to a transverse axis of the golf club head 3200, the CG y-axis 3614 may correspond to a longitudinal axis of the golf club head 3200, and the CG z-axis 3616 may correspond to a vertical axis of the golf club head 3200. The apparatus, methods, and articles of manufacture described herein are not limited in this regard.

For the center axis 3648 of the shaft 3248 to pass through or pass near the CG 3610 as described herein, any portion of the hosel portion 3245 may intersect or be located near a vertical plane that generally faces the front portion 3250 and the rear portion 3260 and is defined by the CG x-axis 3612 and the CG z-axis 3616 (i.e., the CG xz plane) and a vertical plane that generally faces the heel portion 3240 and the toe portion 3230 and is defined by the CG y-axis 3614 and the CG z-axis 3616 (i.e., the CG yz plane). Any portion of the hosel portion 3245 may also intersect or be located near a horizontal plane that generally faces the top portion 3270 and the sole portion 3280 and is defined by the CG x-axis 3612 and the CG y-axis 3614 (i.e., the CG xy plane). The apparatus, methods, and articles of manufacture described herein are not limited in this regard.

In one example, as shown in FIGS. 32-39, the hosel portion 3245 may be located in the recess portion 3279 and/or in the lower portion 3274 of the top portion 3270. In other words, the hosel portion 3245 may be located as low as possible on the body portion 3210 so as to be as close as possible to the horizontal plane defined by the CG x-axis 3612 and the CG y-axis 3614 (i.e., the CG xy plane). Accordingly, the recess portion 3279 allows the hosel portion 3245 to intersect or be located near the horizontal plane defined by the CG x-axis 3612 and the CG y-axis 3614 (i.e., the CG xy plane). In another example, the hosel portion 3245 may be located at any vertical location relative to the CG 3610 as long as the center axis 3648 of the shaft 3248 passes through or passes near the center of gravity (CG) 3610 of the golf club head 3200 as described herein. For example, the hosel portion 3245 may be located at or proximate (e.g., directly above) the CG 3610. In an alternative example, the golf club head 3200 may not include the recess portion 3279 and may be similar to the golf club head 2300 of FIGS. 23-31. As such, and in the absence of the recess portion 3279, the hosel portion 3245 may be located at a more elevated position on the top portion 3270 while the center axis 3648 of the shaft 3248 passes through or passes near the center of gravity (CG) 3610 of the golf club head 3200 as described herein. The apparatus, methods, and articles of manufacture described herein are not limited in this regard.

In the example of FIGS. 32-39, at least the stem portion 3247 of the hosel portion 3245 may be tilted relative to a top surface 3291 of the intermediate portion 3275. Additionally or alternatively, at least the stem portion 3247 of the hosel portion 3245 may be tilted relative to the CG Z-axis 3616. In one example, at least the stem portion 3247 of the hosel portion 3245 may lean in a forward direction toward the front portion 3250 and either the heel portion 3240 or the toe portion 3230. Alternatively, at least the stem portion 3247 of the hosel portion 3245 may lean in a rearward direction toward the rear portion 3260 and either the heel portion 3240 or the toe portion 3230. Alternatively still, at least the stem portion 3247 of the hosel portion 3245 may lean in a direction toward only the front portion 3250, only the rear portion 3260, only the heel portion 3240, or only the toe portion 3230. The apparatus, methods, and articles of manufacture described herein are not limited in this regard.

In one example, the center axis 3648 of the shaft 3248 may intersect the CG z-axis 3616 at a point (e.g., point 3891 shown in FIGS. 36-39) located above the CG 3610 such that the center axis 3648 of the shaft 3248 and the CG 3610 are separated by a distance 3849 in the horizontal plane that is defined by the CG x-axis 3612 and the CG y-axis 3614 (i.e., the CG xy plane). The distance 3849 between the center axis 3648 of the shaft 3248 and the CG 3610 may be greater than or equal to 0.0 inch and less than or equal to about 0.25 inch (0.635 cm). In another example, the distance 3849 between the center axis 3648 of the shaft 3248 and the CG 3610 may be greater than or equal to 0.0 inch and less than or equal to about 0.2 inch (0.508 cm). In yet another example, the distance 3849 between the center axis 3648 of the shaft 3248 and the CG 3610 may be greater than or equal to 0.0 inch and less than or equal to about 0.1 inch (0.254 cm). With respect to any of the foregoing examples, the distance 3849 may correspond to the shortest distance from the CG 3610 to the center axis 3648 of the shaft 3248. Alternatively, the distance 3948 may correspond to some other distance from the CG 3610 to the center axis 3648 of the shaft 3248. The apparatus, methods, and articles of manufacture described herein are not limited in this regard.

In the example of FIGS. 32-39, the body portion 3210 may include a first weight region 3412 and a second weight region 3512. The first weight region 3412 may be located on the toe side 3232 of the lower portion 3274 and include a first weight platform portion 3414 having a first set of weight ports 3420 (e.g., shown as weight ports 3421, 3422, 3423, 3424, and 3425) configured to receive a weight portion of a first set of weight portions 3430 (e.g. shown as weight portions 3431, 3432, 3433, 3434, and 3435). The second weight region 3512 may be located on the heel side 3242 of the lower portion 3274 and include a second weight platform portion 3514 having a second set of weight ports 3520 (e.g., shown as weight ports 3521, 3522, 3523, 3524, and 3525) configured to receive a weight portion of a second set of weight portions 3530 (e.g. shown as weight portions 3531, 3532, 3533, 3534, and 3535). The weight regions 3412 and 3512, the first and second weight platform portions 3414 and 3514, the first set of weight ports 3420 (e.g., shown as weight ports 3421, 3422, 3423, 3424, and 3425), the second set of weight ports 3520 (e.g., shown as weight ports 3521, 3522, 3523, 3524, and 3525), the first set of weight portions 3430 (e.g. shown as weight portions 3431, 3432, 3433, 3434, and 3435), and the second set of weight portions 3530 (e.g. shown as weight portions 3531, 3532, 3533, 3534, and 3535) may be similar in many respects to the weight regions, weight platform portions, weight ports, and/or weight portions of the golf club head 2300 of FIGS. 23-31. The apparatus, methods, and articles of manufacture described herein are not limited in this regard.

The first weight platform portion 3414, the first set of weight ports 3420 (e.g., weight ports 3421, 3422, 3423, 3424, and 3425), and/or the first set of weight portions 3430 (e.g., weight portions 3431, 3432, 3433, 3434, and 3435) may form a first visual guide portion 3442. The second weight platform portion 3514, the second set of weight ports 3520 (weight ports 3521, 3522, 3523, 3524, and 3525), and/or the second set of weight portions 3530 (weight portions 3531, 3532, 3533, 3534, and 3535) may form a second visual guide portion 3542. The golf club head 3200, and more particularly, the center portion 3278 may also include a third visual guide portion 3642, which may be substantially equidistant from the first and second visual guide portions 3442 and 3542. For example, the third visual guide portion 3642 may extend between the front and rear portions 3250 and 3260 located at or proximate to a center of the body portion 3210. The third visual guide portion 3642 may have a first portion 3643 that may extend from the rear portion 3260 to the recess portion 3279 and a second portion 3645 that may be aligned with the first portion 3643 and extend from the recess portion 3279 to the front portion 3250. Accordingly, the first and second portions 3643 and 3645 of the third visual guide portion 3642 may be separated from one another by the recess portion 3279, and the hosel portion 3245 and the shaft 3248 may be positioned between the first and second portions 3643 and 3645 of the third visual guide portion 3642. The third visual guide portion 3642 may be the same as or different from the first and/or second visual guide portions 3442 and 3542, respectively. In one example, the third visual guide portion 3642 may be a recessed line portion having a certain color. Accordingly, the first portion 3643 may be recessed line portion and the second portion 3645 may be a recessed line portion. In another example, the third visual guide portion 3642 may include a plurality of weight ports (not shown) with a plurality of weight portions (not shown) received therein. Alternatively, the third visual guide portion 3642 may be defined by a raised portion of the top portion 3270. The third visual guide portion 3642 may be similar in many respects to any of the visual guide portions described herein. The apparatus, methods, and articles of manufacture described herein are not limited in this regard.

In one example, the remaining portions of the golf club head 3200 may be similar in many respects to the golf club head 2300 of FIGS. 23-31. For example, the face portion 3255 may include a face insert (not shown), which may be attached to the front portion 3250 with fasteners (not shown). In another example, the body portion 3210 may include an interior cavity (not shown) and a cover or sole plate (not shown) that may be attached to the sole portion 3280 with fasteners (not shown) to cover an opening (not shown) of the interior cavity. In another example, the interior cavity may be unfilled or filled partially or fully with a filler material. Alternatively, the golf club head 3200 may not be similar in many respects to the golf club head 2300 of FIGS. 23-31. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising: a body portion comprising: a toe portion; a heel portion opposite the toe portion; a front portion having a face portion; a back wall portion opposite the face portion and extending from the toe portion to the heel portion; a rear portion opposite the front portion; a top portion including a center portion extending from the front portion to the rear portion, the center portion having a first portion protruding from the back wall portion, a second portion positioned at or proximate the rear portion, and an intermediate portion located in a recess portion between the first portion and the second portion, the intermediate portion having a different height than both the first portion and the second portion; and the center portion further having a first side wall and a second side wall opposite the first side wall, the first and second side walls extending from the back wall portion toward the rear portion and configured such that the center portion extends from the front portion to the rear portion at a first width before gradually narrowing to a second width and then gradually widening back to the first width; and a hosel portion located at the intermediate portion of the center portion, the hosel portion configured to receive a shaft such that a center axis of the shaft intersects a point on a vertical axis passing through a center of gravity of the golf club head.

2. A golf club head as defined in claim 1, wherein the center portion is substantially equidistant from the toe portion and the heel portion, and wherein the hosel portion is located above the center of gravity of the golf club head.

3. A golf club head as defined in claim 1, wherein the hosel portion leans in a direction toward at least one of the front portion, the rear portion, the toe portion, and the heel portion.

4. A golf club head as defined in claim 1, wherein the point on the vertical axis is located above the center of gravity.

5. A golf club head as defined in claim 1, wherein a distance between the center axis and the center of gravity of the golf club head is less than or equal to 0.25 inch (0.635 cm).

6. A golf club head as defined in claim 1, wherein the center portion comprises a visual guide having a first portion and a second portion that are aligned in a direction from the front portion to the rear portion, and wherein the hosel portion and the shaft are positioned between the first and second portions of the visual guide.

* * * * *